US011759384B2

(12) United States Patent
Mitschke

(10) Patent No.: US 11,759,384 B2
(45) Date of Patent: Sep. 19, 2023

(54) SYSTEM FOR ASSISTING MOBILITY-IMPAIRED INDIVIDUAL AND METHODS OF USE

(71) Applicant: Larry A. Mitschke, Spring, TX (US)

(72) Inventor: Larry A. Mitschke, Spring, TX (US)

( * ) Notice: Subject to any disclaimer, the term of this patent is extended or adjusted under 35 U.S.C. 154(b) by 0 days.

(21) Appl. No.: 17/840,583

(22) Filed: Jun. 14, 2022

(65) Prior Publication Data

US 2022/0395418 A1 Dec. 15, 2022

Related U.S. Application Data

(60) Provisional application No. 63/210,568, filed on Jun. 15, 2021.

(51) Int. Cl.
*A61H 3/00* (2006.01)

(52) U.S. Cl.
CPC ..... *A61H 3/008* (2013.01); *A61H 2003/007* (2013.01); *A61H 2201/1207* (2013.01);
(Continued)

(58) Field of Classification Search
CPC ..... A61H 3/008; A61H 2003/007; A61H 2201/1207; A61H 2201/1463; A61H 2201/1642; A61H 2201/1652; A61H 2201/5064; A61H 1/00; A63B 21/4001; A63B 69/0002; A63B 21/00181; A63B 24/0087; A63B 23/0464; A63B 21/068; A63B 69/0064; A63B 21/4007;
(Continued)

(56) References Cited

U.S. PATENT DOCUMENTS 2,773,499 A * 12/1956 Zur Nieden ..... A61H 1/0222 602/32
4,125,908 A * 11/1978 Vail ..... A61G 7/1042 105/155

(Continued)

FOREIGN PATENT DOCUMENTS

| | | |
|---|---|---|
| CN | 106241603 | 12/2016 |
| CN | 210355207 | 4/2020 |
| WO | 2018108221 | 6/2018 |

OTHER PUBLICATIONS

International Search Report and Written Opinion dated Oct. 17, 2022 from corresponding International Application No. PCT/US2022/033505.

*Primary Examiner* — Garrett K Atkinson
(74) *Attorney, Agent, or Firm* — HULSEY P.C.

(57) ABSTRACT

The present invention discloses a system for assisting a mobility-impaired individual or a patient. The system includes a track that mounts to a ceiling or wall of a structure such as a home. The track receives a sliding mechanism. The sliding mechanism connects to a strap hanging arrangement. The strap hanging arrangement connects to a vest. The vest connects to a leg support mechanism. The mobility-impaired individual wears the vest and the leg support mechanism. The sliding mechanism includes a lift strap for adjusting the height of the strap hanging arrangement thereby allowing the mobility-impaired individual to be placed in a sitting position or standing position. The mechanically driven mechanism moves along the track allowing the mobility-impaired individual to move around the structure.

20 Claims, 18 Drawing Sheets

(52) U.S. Cl.
CPC ..... *A61H 2201/1463* (2013.01); *A61H 2201/1642* (2013.01); *A61H 2201/1652* (2013.01); *A61H 2201/5064* (2013.01)

(58) Field of Classification Search
CPC ..... A63B 2225/50; A63B 2225/20; A63B 2220/805; A63B 2220/54; A63B 2220/51; A63B 2220/40; A63B 2220/30; A63B 2220/10; A63B 2071/0018; A63B 2024/0093; A63B 23/0458; A63B 22/0235; A63B 71/0622; A63B 2022/0092; A63B 2208/0204; A63B 2022/0094
See application file for complete search history.

(56) References Cited

U.S. PATENT DOCUMENTS 4,243,147 A * 1/1981 Twitchell ..... A61G 7/1042 212/327
4,896,659 A * 1/1990 Goldish ..... A61H 1/0218 602/19
5,314,390 A * 5/1994 Westing ..... A63B 21/4034 601/36
5,830,162 A * 11/1998 Giovannetti ..... A61B 5/1038 482/69
6,880,487 B2 * 4/2005 Reinkensmeyer ... A01K 15/027 119/728
7,125,388 B1 * 10/2006 Reinkensmeyer ..... A63B 69/0064 601/5
7,381,163 B2 * 6/2008 Gordon ..... A63B 22/02 482/69
7,938,757 B1 * 5/2011 Cockrell ..... B66C 17/06 297/274
7,980,856 B2 * 7/2011 Grabiner ..... A63B 24/00 434/258
7,998,040 B2 * 8/2011 Kram ..... A63B 21/055 482/54
9,272,223 B2 * 3/2016 Checketts ..... A63G 21/22
9,510,991 B2 * 12/2016 Stockmaster ..... A61H 3/008
9,713,439 B1 * 7/2017 Wu ..... A61B 5/221
9,801,775 B2 * 10/2017 Vallery ..... A63B 21/4009
9,867,754 B2 * 1/2018 Burke ..... A61H 3/008
10,232,209 B2 * 3/2019 Pouchet ..... A63B 71/0622
10,463,563 B2 * 11/2019 McBride ..... A61H 3/008
10,668,316 B2 * 6/2020 Mcbride ..... A63B 69/0002
2004/0143198 A1 * 7/2004 West ..... A61H 1/0262 601/5
2006/0229167 A1 * 10/2006 Kram ..... A63B 21/4015 482/54
2009/0199335 A1 * 8/2009 Guldmann ..... A61G 7/1015 5/87.1
2012/0018249 A1 * 1/2012 Mehr ..... A63B 69/0064 182/5
2013/0116604 A1 * 5/2013 Morilla ..... A63G 9/12 601/33
2014/0206503 A1 * 7/2014 Stockmaster ..... A61H 3/008 482/4
2015/0320632 A1 * 11/2015 Vallery ..... A61G 7/1042 482/69
2016/0256346 A1 * 9/2016 Stockmaster ..... G16H 40/63
2017/0027803 A1 * 2/2017 Agrawal ..... A61B 5/1122
2017/0087392 A1 * 3/2017 Lambert ..... A61H 3/008
2017/0135893 A1 * 5/2017 Stockmaster ..... A61H 3/008
2017/0232289 A1 * 8/2017 Pouchet ..... A63B 23/03533 482/93
2018/0055715 A1 * 3/2018 Vallery ..... A63B 21/4009
2020/0222266 A1 * 7/2020 Gordon ..... A61H 3/008

* cited by examiner

SYSTEM FOR ASSISTING MOBILITY-IMPAIRED INDIVIDUAL AND METHODS OF USE

RELATED APPLICATIONS AND CLAIM FOR PRIORITY

The present application claims the benefit of U.S. Provisional Patent Application No. 63/210,568 filed Jun. 15, 2021, and titled "SYSTEM FOR ASSISTING MOBILITY-IMPAIRED INDIVIDUALS,"; which is incorporated herein by its entirety and referenced thereto.

FIELD OF THE INVENTION

The present invention generally relates to a field of mobility assistance systems. More specifically, the present invention relates to a system for assisting a mobility-impaired individual or a patient suffering from medical conditions in the course of fall prevention, medical care, therapy, rehabilitation diagnostics, etc.

BACKGROUND OF THE INVENTION

Devices or systems exist in the art that help in rehabilitation of mobility-impaired individuals or patients. The devices help them in walking, sitting and standing positions. Examples of the devices include wheelchairs, exoskeletons, and various types of overhead support, lift and transport devices, etc.

Several devices that assist mobility-impaired individuals or injured individuals have been disclosed in the past. One such example is disclosed in a United States Publication No. 20170087392 entitled "Fall prevention system for peripatetic persons" (the "'392 Publication"). The '392 Publication provides a personal support system for use by physically disabled and/or otherwise unstable persons. The support system generally includes: a body harness donned by the user; a navigational surface mounted to the ceiling or other overhead support feature in a structure; a device mounted for movement along the navigational surface; a retractable line such as a strap extending between the body harness and mounted moving device; a motor to control the winding and unwinding of the cable/strap; and a control module for the motor. The '392 Publication requires that the user be able to walk in order to move along the navigational system or must have assistance from another person. In the '392 Publication, mechanically powered movement along the navigational system is not provided.

Another example is disclosed in a U.S. Pat. No. 4,243,147 entitled "Three-dimensional lift" (the "'147 Patent"). The '147 Patent discloses a three-dimensional lift intended for use by a handicapped person, providing him with three dimensions of mobility within a room or rooms. The invention consists of uniform channels or rails secured in parallel configuration adjacent to or on a room ceiling with a traveling bridge arranged to traverse the length of the channels, and incorporates with the bridge a head mounted to travel thereacross spanning the room or rooms with a sling suspended therefrom to move vertically, supporting the handicapped person, and includes a remote control hung from the head, accessible to and giving the handicapped person the capability to operate the device while he is seated in the sling, providing that person with three dimensions of travel that they control. The invention includes two motors that are arranged with the head turning sprockets in fixed chains connecting between the wall channels across the traveling bridge to provide movement of the traveling bridge and head thereacross, with a third motor providing vertical movement of the sling. The motors are preferably operated by a low voltage system, preferably through batteries, to limit a potential for dangerous electrical shock to the handicapped person should the control contact water. The '147 Patent does not provide support for the user in a standing/walking position to facilitate rehabilitation, and it is limited to a space having the same ceiling height (not through doorways which are almost always lower clearance vs ceiling) to enable the horizontal (flat) beam design.

Another example is disclosed in a United States Publication No. 20090199335 entitled "Ceiling mounted hoist system" (the "'335 Publication"). The '335 Publication discloses a hoisting system with a hoisting apparatus for hoisting persons, e.g., physically handicapped persons, where the hoist system includes at least one trolley and at least one hoisting apparatus, which are integrated and provided assembled in a rail arranged therefor, where the system is driven by at least one motor. By building the trolley together with the hoisting apparatus, there is achieved the great advantage that the hoisting apparatus is hidden inside the rail. Thus, a much more discreet and smart system is achieved where, otherwise, a large and unsightly hoisting apparatus would hang under the rail. Furthermore, an increased clearance between the hoist system and the floor is attained. The '335 Publication does not provide support for the user in a standing/walking position to facilitate rehabilitation, and it is limited to a space having the same ceiling height (not through doorways which are almost always lower clearance vs ceiling) to enable the horizontal (flat) beam design.

Yet Another example is disclosed in a U.S. granted Pat. No. 10,463,563 entitled "Methods and apparatus for body weight support system" (the "'563 Patent"). The '563 Patent discloses an apparatus including a drive mechanism, a patient support mechanism, and an electronic system. The drive mechanism is included in a trolley and is configured to suspend the trolley from a support track. The drive mechanism includes a first sensor configured to sense an operating condition of the drive mechanism. The patient support mechanism couples to the trolley and includes a tether and a second sensor. The tether can be operatively coupled to a patient such that the patient support mechanism supports the patient. The second sensor is configured to sense an operating condition of the patient support mechanism. The electronic system is included in the trolley and has at least a processor and a memory. The processor is configured to define a gait characteristic of the patient based at least in part on a signal received from the first sensor and a signal received from the second sensor.

Yet another example is disclosed in a United States Publication No. 20140206503 entitled "Medical rehab lift system and method with horizontal and vertical force sensing and motion control" (the "'503 Publication"). The '503 Publication discloses a body-weight support system including an improved lift system and method. The system enables not only the support of patients undergoing rehab therapies, but including exercise modes that are both customizable and dynamic in nature, as well as a track system, wherein the system is capable of providing alternative functionality at differing locations. Other features disclosed include a system by which a movable support unit tracks or follows a patient, adjustable and variable supportive forces for users based upon, for example, a percentage of sensed body weight, and a user-interface that may be employed in a mobile, wired or wireless manner and will allow the use of multiple lift systems on a single, looped track system.

The above discussed mobility assistance systems provide fall prevention, lifting, transporting, support while standing, support while sitting, and movement throughout a house or structure. However, they require some, if not significant, help from another person in order to use the system. Further, the existing systems often limit the user to only a standing or sitting position. Further, the existing systems limit movement to a single room without losing support while going to the next room. Further, the existing systems require a transfer device to have support between rooms or between levels of a structure. Further, the existing systems require significant changes to doorways and ceilings, or additions such as additional supporting rails for support to be in place. Further, the existing systems are not designed to provide continuous support throughout multiple story (level) structures. Some of the above designs utilise a horizontal beam system, which is planar in nature. These designs do not allow for vertical movement of the shuttle nor vertical and horizontal curvature of the track to facilitate continuous supported movement of the user between spaces having different ceiling heights (through low doorways). Their designs are confined to operating on a flat (planar) type of track.

In addition, the existing systems require the user to be able to walk in order to use the system (i.e. they must have physical strength to stand and/or walk to use the device). Further, the existing systems require adjustments to the components that a limited mobility user may not be able to reach and achieve, and are not designed for more than one user at a time. Further, the existing systems require additional parallel beams to facilitate multiple users. Further, the existing systems do not indicate the location of the user within the structure. Further, the existing systems have body harnesses or slings which limit position, freedom of movement, and direction of movement and place undue force on user's chest and waist. Furthermore, the existing systems require precise strap adjustment to determine body positioning, and do not easily allow for bathing and toilet functions nor provide support during such functions.

Furthermore, the existing systems have a number of problems and inconveniences. For example, the existing systems require the user to have physical strength to use the systems (holding on to lifting lines in order to be secure). Further, the movement of the user is limited to a single room without having to be moved and set up again in another room (typical of the flat beam designs). Further, the lifting and supporting mechanism is not designed for comfort so that the user can stay in it for long periods of time. Further, the existing systems do not provide flexibility for varying degrees of support required by the user.

Additionally, the systems are expensive, unsightly, cumbersome, and require assistance by another person in order for the user to be able to function. Existing systems do not address a way to provide safe support during bathing and toilet daily functions. Attempts by other designs to provide a system of support for multiple users at the same time are vague in description and are limited to the flat beam designs which typically limit movement to a single room without having to be moved and reinstalled in the next room, so assistance is required for the user.

Therefore, there is a need for an improved system for assisting a mobility-impaired individual or a patient suffering from medical conditions in the course of medical care, therapy, rehabilitation diagnostics, etc., without causing any discomfort or pain to the mobility-impaired individual.

BRIEF SUMMARY OF THE INVENTION

It is an object of the present invention to provide a system for assisting a mobility-impaired individual, the drawback of known sUS0 ension systems, wheelchairs and/or prosthetic apparatuses.

It is an object of the present invention to address the shortcomings of known sUS0 ension systems, wheelchairs and/or prosthetic apparatuses and offer more flexibility for the user in type and amount of support, freedom of movement and position, secure mechanical lift, movement, and positioning, and accommodates multiple users at the same time.

It is another object of the present invention to provide complete independence for the user so that they can live alone without help from others such as a care giver.

It is another object of the present invention to provide a means for a care giver to assist and care for the user, such as in the case of the user with dementia or extreme limiting physical conditions.

It is yet another object of the present invention to provide "One System" that has the flexibility to deliver in home care assistance from the onset of slight physical limitations all the way through all care being provided by a care giver. The system allows the user or care giver to increase or decrease amount and type of support required to meet the needs of the user.

It is yet another object of the present invention to provide a unique design unique in that the support track can curve vertically and horizontally thereby providing a continuous support track between rooms of different ceiling heights, through doorways typically having low clearance, from level to level of structure, and giving access to rooms often having very small areas such as the toilet or bath area without altering the structure itself. The system only requires installation of the safety track. The system provides fully mechanized movement along the track as well as mechanized vertical lifting, therefore the user does not have to be able to stand or walk to use the system. Additionally, position security in the vertical and horizontal directions are mechanically controlled and locked in when motors are static so there is no slippage causing risk to the user.

It is yet another object of the present invention to provide a system for use in the home, nursing homes, hospitals, and memory care facilities.

It is yet another object of the present invention to greatly reduce the physical strength requirement of the care giver and reduce or eliminate the number of caregivers required. The system provides much safer support of the user/patient/resident, and will greatly reduce the time required to complete tasks.

It is yet another object of the present invention to provide a system for assisting a mobility-impaired individual to move around a structure without the need for additional devices such as wheelchairs or prosthetic apparatuses.

It is yet another object of the present invention to provide a continuous system for assisting a mobility-impaired individual to move around a structure between rooms having different ceiling heights and having low doorway clearance heights using the same rail system without the need for a transfer device. Support is continuous, safe, and uninterrupted.

It is yet another object of the present invention to provide a system for assisting multiple mobility-impaired individuals at the same time using the same system.

It is yet another object of the present invention to provide a system for assisting multiple mobility-impaired individuals at the same time and providing choice of directional movement, spacing between, and choice of type of support that is independent of the other user(s).

It is yet another object of the present invention to provide a system for assisting multiple mobility-impaired individuals at the same time and allow users to move past each other while traveling in the same or opposite directions.

In order to overcome the limitations and to achieve the objects stated herein, the present invention provides a system for assisting a mobility-impaired individual or a patient. The system includes a track. The track mounts to the ceiling or walls of a structure such as a home. The track receives a sliding mechanism (shuttle). The sliding mechanism connects to a strap hanging (yoke) arrangement. The strap hanging (yoke) arrangement further connects to a vest. The vest contains a leg support mechanism to support sitting, and contains balance rings which connect the vest to the strap hanging (yoke) arrangement. The mobility-impaired individual wears the vest which includes the leg support mechanism. The shuttle includes a weight bearing axle, directional drive axle, differential drive system, lift device, and strap for adjusting the height of the strap hanging arrangement thereby allowing the mobility-impaired individual to be placed in a sitting position or standing position. The sliding (mechanically driven) shuttle moves along the track allowing the mobility-impaired individual to safely move around the structure.

In one advantageous feature of the present invention, the system allows for the mobility-impaired individual to move around the structure in sitting or standing position on his/her own or with the help of a caretaker.

In one advantageous feature of the present invention, the system allows for adjusting the height of the strap hanging arrangement such that the mobility-impaired individual will be able to adjust the system to his sitting or standing position or desired amount of support.

In another advantageous feature of the present invention, the system allows for controlling forward or backward movement of the sliding mechanism. This way, the mobility-impaired individual can move around the structure without help from a caretaker or additional devices such as wheelchairs, for example.

In another advantageous feature of the present invention, the strap hanging arrangement or strap hanging mechanism encompasses a swivel and a padded cross bar, without requirement for adjustment straps. The strap hanging arrangement without adjustment straps is easy to slip on. As such, the strap hanging arrangement is safer to use, and faster to install on the user. Further, strap hanging arrangement requires no straps to adjust that are overhead and hard for the user to reach, as on other systems, so the user is less reliant on others for using the system. The swivel allows freedom of directional positioning for the user; and it prevents the lift strap from becoming entangled on the lifting axle & possibly damaging the lifting strap, or becoming jammed at the lift axle thereby preventing lifting from occurring. The padded cross bar minimizes injury to the user if the strap hanging arrangement accidentally slips/falls and hits the user.

Additionally, the vest is designed such that there are no vertical adjustment straps on the main upper body portion of the vest. The vest is designed to include only the horizontal adjustment straps on the main upper body. As a result, the vertical lifting force is applied to the overall vest, so the force is not applied to any vertical lifting straps which might slip and cause harm to the user by dropping them/causing them to fall. Here, the lifting force is perpendicular to the vest enclosure straps, so the stress on the enclosure straps is reduced and they don't tighten, which makes the vest more comfortable.

Further, the vest includes balance rings to provide freedom of movement for the user to be able to lean forward or backward and still have support. This reduces the amount of neck strain & head/neck movement required to view chosen field of vision such as when looking up or down. The vest provides support for the user in the standing and sitting position, unlike known systems, which require different support device when standing or sitting, but not both.

Furthermore, the vest includes arm positioner straps. The arm positioner straps help to secure the vest to the user even if the leg straps are not being used. The arm positioner straps prevent a user that may have diminished cognitive function from raising arms overhead where they could possibly become entangled in the system components.

In another advantageous feature of the present invention, the track is designed to curve vertically and horizontally. In other words, the track is not configured to be planar or substantially planar. This allows the track to act as a continuous support track between multiple level structures, rooms of different ceiling/clearance heights, and through doorways which typically have lower clearance heights than the rooms themselves. This avoids the drawback of known systems having in support surface that is planar or substantially planar in nature and are limited to a room/space of constant ceiling/clearance height, or require a transfer device to move between rooms; or the entire support system must be moved to the next room and re-set to provide support in the next area.

Further, the track incorporates beam supports, to provide load support in the vertical direction, reduce horizontal sway from horizontal stress, and to lock sections of the track together for structural integrity.

In yet another advantageous feature of the present invention, the shuttle is designed to support the load wholly or substantially in a single vertical plane for both dual axle shuttle design or a single axle shuttle design. Load support in a single vertical plane allows the shuttle to traverse a non-planar track, as well as a planar track. This avoids the drawback of known systems having shuttles with multiple load support axles that are on rigid bodies so they support their load in multiple vertical planes and thus the shuttle cannot traverse a vertically curving track nor a horizontally curving track.

Further, the shuttle has a load axle pivot point which is in a single vertical plane at any point of location along the track (the same single vertical plane as the load support). The pivot point in a single vertical plane allows the shuttle to traverse a non-planar track, as well as a planar track. The shuttle is designed to lock its position and remain in place when not moving. Locking state is achieved using geared wheels/drive axle/motor, or by using frictional engagement of shuttle components and track, or a combination thereof. Locking the shuttle provides safety for the user, especially on sloping sections of the track.

Furthermore, the shuttle encompasses a differential drive mechanism or differential drive unit. The differential drive unit allows the shuttle to traverse horizontally along curving track sections (both horizontally and vertically at the same time). Specifically, the differential drive unit allows the two axle sections of the drive axle, and the wheels thereon, to turn at different speeds. The axle and wheels on one side of the differential drive turn at a different speed than the axle and wheels on the other side.

Furthermore, the track incorporates a track turntable to allow the shuttle to move between intersecting track sections. Intersecting tracks provide greater freedom of directional movement, and give access to more areas within a room or structure. Further, the intersecting tracks allow flexibility of movement of multiple users that is independent of other users. The track turntable allows multiple users or animals to be on the same track or on other sections of track and cross pathways with other users.

In yet another advantageous feature of the present invention, the system includes sensors positioned at one of the shuttle, the track, the track turntable, and the lifting strap. The sensors enable recognition of the user's location and positioning along the track within the structure. In one implementation, the sensors are programmed to enable movements using a control module (remote control), or an electronic device such as mobile phone, computer, or similar having appropriate software to carry out single movements or a series of shuttle movements by a specific button or interface or by voice command. For example, consider the user is in the living room sitting in a chair and wishes to go into the kitchen for a glass of water. Here, the user selects the "kitchen" button on the remote control or says "take me to the kitchen walking", and the computer controller lifts the user to the standing position, and the shuttle begins traversing the track until the user is in the kitchen.

Features and advantages of the invention hereof will become more apparent in light of the following detailed description of selected embodiments, as illustrated in the accompanying FIGURES. As will be realized, the invention disclosed is capable of modifications in various respects, all without departing from the scope of the invention. Accordingly, the drawings and the description are to be regarded as illustrative in nature.

BRIEF DESCRIPTION OF THE DRAWINGS

The present invention will now be described in detail with reference to the drawings, which are provided as illustrative examples of the invention as to enable those skilled in the art to practice the invention. It will be noted that throughout the appended drawings, like features are identified by like reference numerals. Notably, the FIGURES and examples are not meant to limit the scope of the present invention to a single embodiment, but other embodiments are possible by way of interchange of some or all of the described or illustrated elements and, further, wherein.

DETAILED DESCRIPTION OF THE EMBODIMENTS

Figure 1:
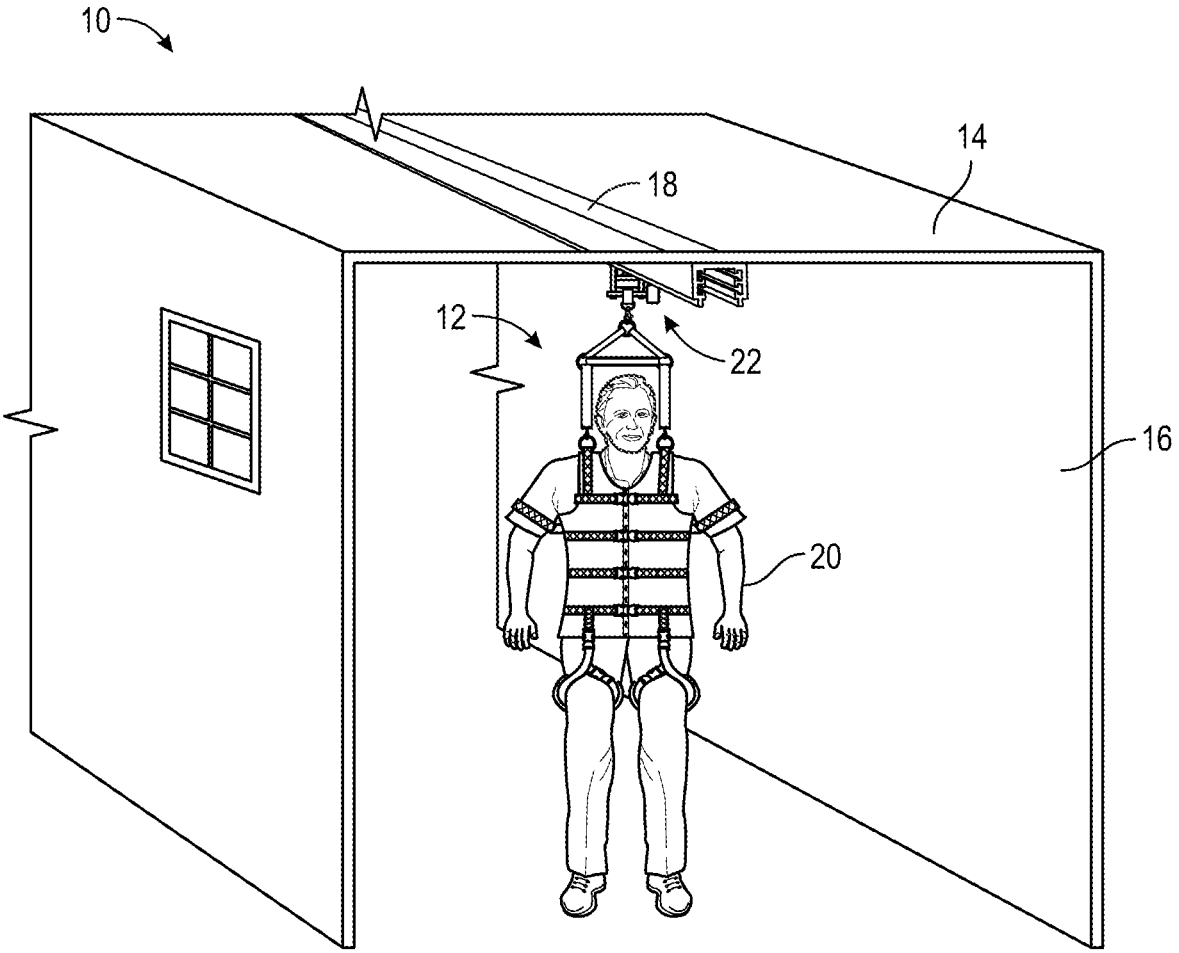
FIG. 1 illustrates an environment of a system for assisting a mobility-impaired individual or a patient, in accordance with one embodiment of the present invention.

The detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed system. However, it will be apparent to those skilled in the art that the presently disclosed invention may be practiced without these specific details. In some instances, well-known structures and devices are shown in functional or conceptual diagram form in order to avoid obscuring the concepts of the presently disclosed system.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention describes a system, it is to be further understood that numerous changes may arise in the details of the embodiments of the system. It is contemplated that all such changes and additional embodiments are within the spirit and true scope of this invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the invention and are not intended to limit the scope of the invention.

It should be understood that the present invention describes a system for fall prevention and assisting a mobility-impaired individual or a patient. The system includes a track that mounts to a ceiling of a structure such as a home. The track receives a sliding mechanism. The sliding mechanism connects to a strap hanging arrangement. The strap hanging arrangement connects to a vest. The vest connects to a leg support mechanism. The mobility-impaired individual wears the vest and the leg support mechanism. The sliding mechanism includes a lift strap for adjusting the height of the strap hanging arrangement thereby allowing the mobility-impaired individual to be placed in a sitting position or standing position. The sliding mechanism rolls along the track or is mechanically driven allowing the mobility-impaired individual to move around a structure.

Various features and embodiments of a system for assisting a mobility-impaired individual are explained in conjunction with the description of FIGS. 1 to 21.

In one embodiment, the present invention discloses a system for assisting a mobility-impaired individual. FIG. 1 shows an environment 10 of system 12 for assisting a mobility-impaired individual, in accordance with one exemplary embodiment of the present invention. System 12 suspends from ceiling 14 of structure 16. In one example, structure 16 indicates a building such as a home. In another example, structure 16 indicates a specifically configured housing such as a cantilever beam. Ceiling 14 provides track 18 that extends facing towards ground. Track 18 mounts to ceiling 14 using a variety of means such as welding, fasteners, hook and loops, adhesive, or any other mechanism known in the art. Considering structure 16 is a home, track 18 runs along the entire home or rooms as desired. Track 18 provides a material made of metal, hard plastic, wood or any other material. Track 18 comes in a variety of shapes such as straight, curved, square, rectangular, along the side of walls in structure, or in a loop allowing mobility-impaired individual 20 to move around structure 16 with the help of system 12. A person skilled in the art understands that track 18 comes in a variety of configuration including vertical or horizontal curvature depending on the need. Here, mobility-impaired individual 20 wears system 12 and slides/rolls along track 18 in sitting or standing position. Mobility impaired individual 20 indicates an individual or a patient suffering from medical conditions in the course of medical care, therapy, rehabilitation diagnostics, etc.

Figure 2:
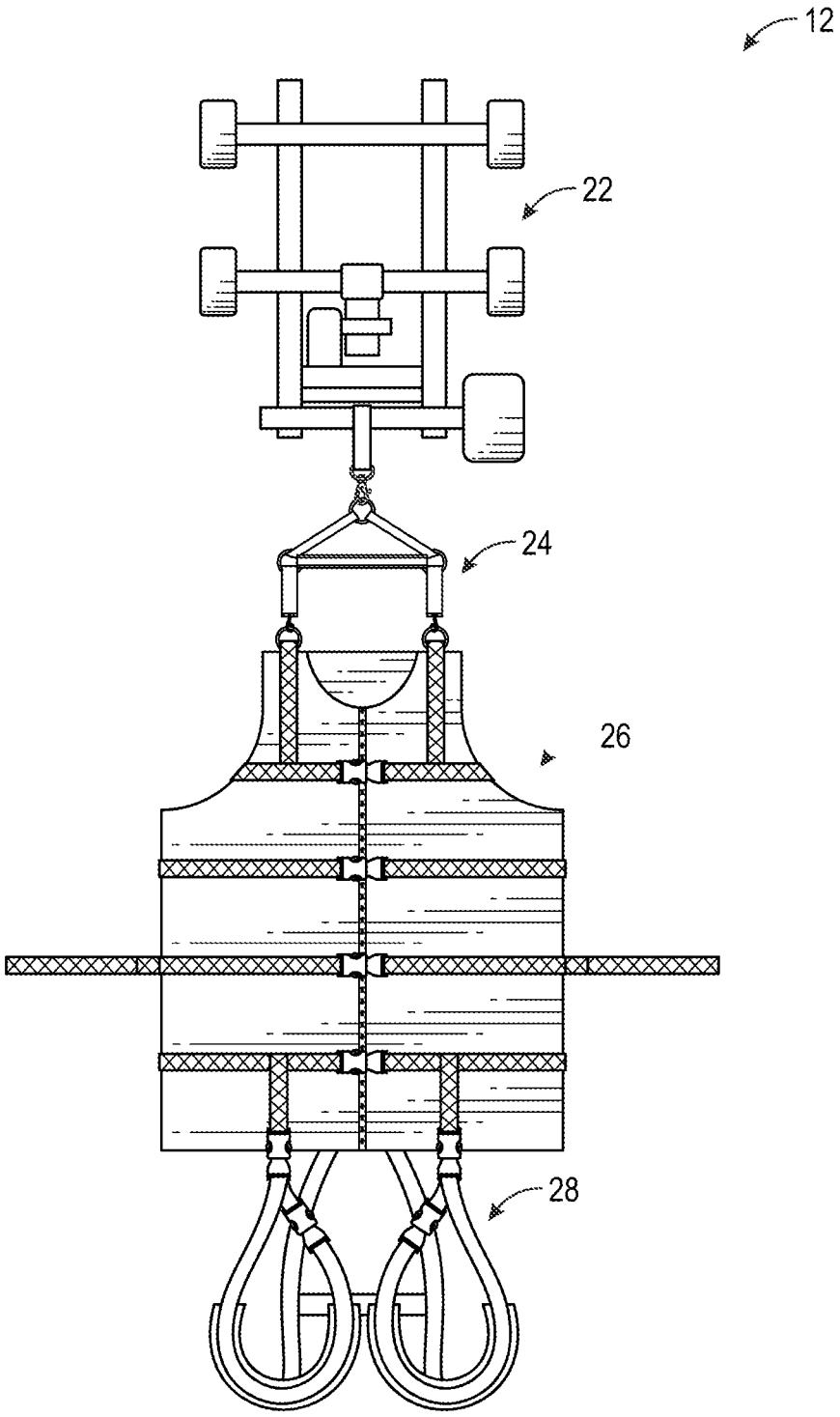
FIG. 2 illustrates a front view of system.

FIG. 2 shows a front view of system 12, in accordance with one embodiment of the present invention. System 12 includes sliding mechanism or shuttle 22, lifting yoke 24, vest 26 and leg support mechanism 28.

Figure 3:
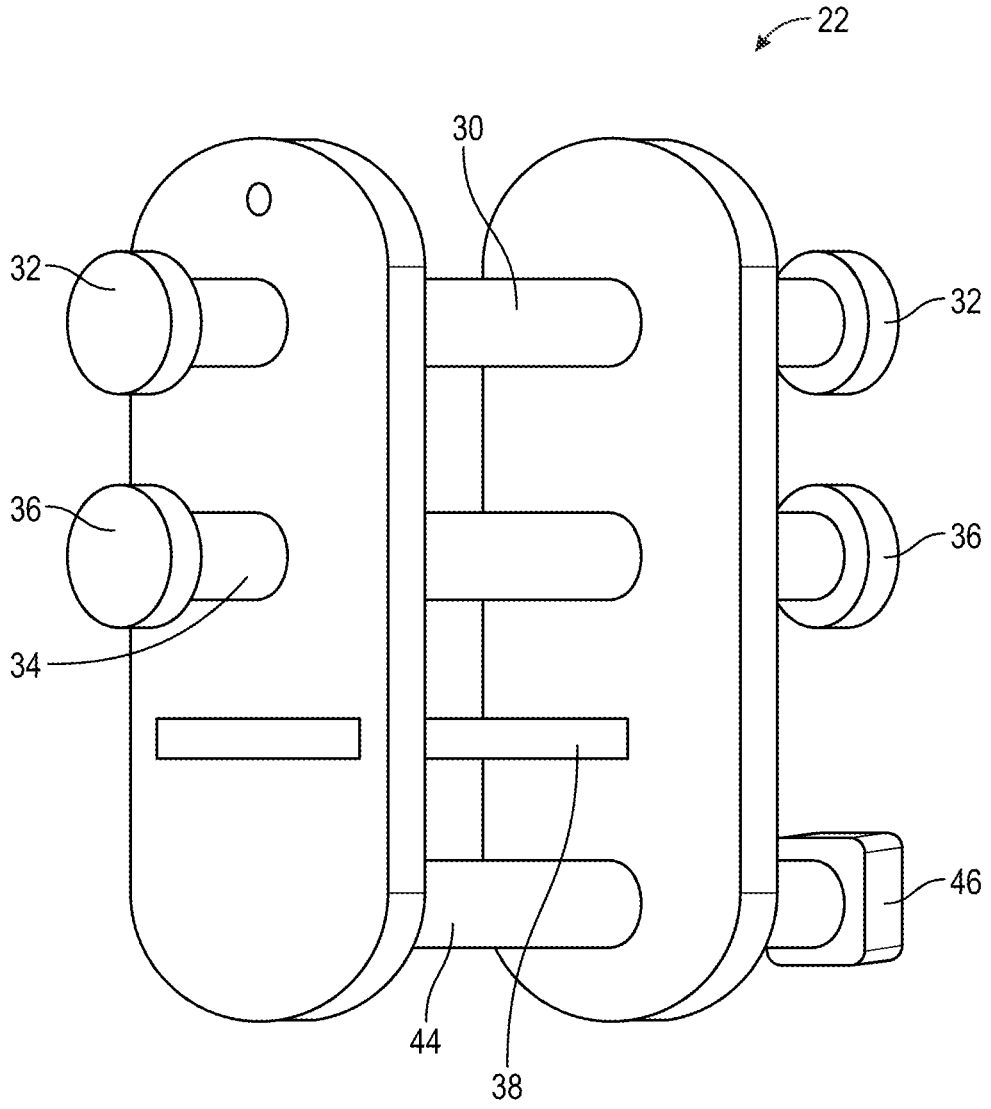
FIGS. 3 and 4 illustrate a side perspective view and a front view, respectively, of a sliding mechanism.

FIG. 3 shows a side perspective view of sliding mechanism 22, in accordance with one exemplary embodiment of the present invention. Sliding mechanism 22 provides a material made of metal, hard plastic, wood or any other suitable material. Sliding mechanism 22 includes first shaft 30 having first wheels 32. Further, shuttle 22 includes second shaft 34 having second geared wheels 36. Each of first shaft 30 and second shaft 34 comes in a cylindrical configuration. First shaft 30 acts as a weight bearing shaft that withstands the entire weight of system 12 and mobility-impaired individual 20. Second shaft 34 acts as a gear drive shaft that helps to drive system 12 in forward or rearward direction along track 18. In accordance with present invention, first wheels 32 act as load supporting wheels. Second geared wheels 36 indicate gear drive wheels. In addition, shuttle 22 includes motor base plate 38. In one example, motor base plate 38 comes in a rectangular configuration. Here, each of first shaft 30, second shaft 34, and motor base plate 38 mounts in parallel to each other.

Figure 4:
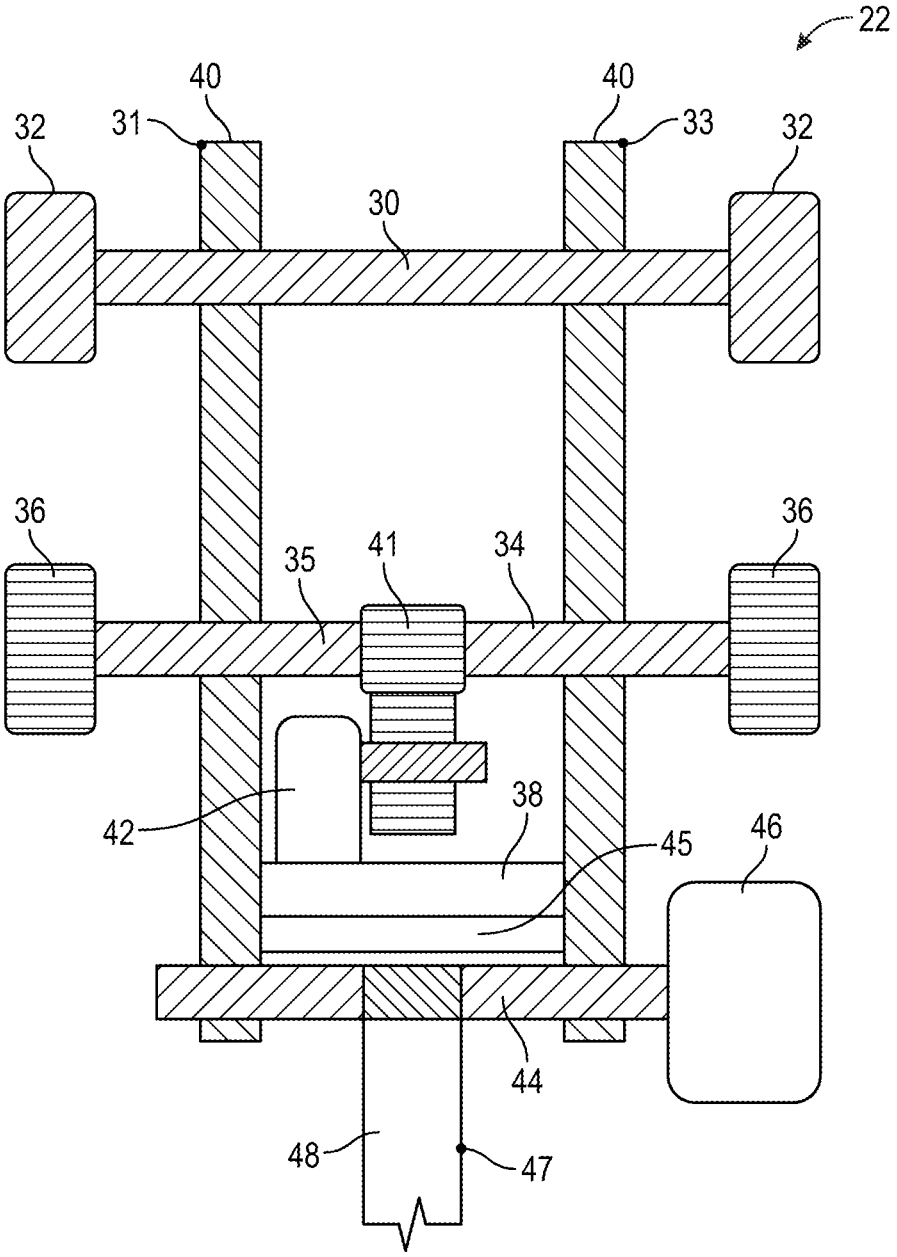

FIG. 4 shows shuttle 22 encompassing stabilizers 40 that connect and stabilize first shaft 30, second shaft 34 and motor base plate 38. Each of first shaft 30 and second shaft 34 draws through stabilizers 40. Stabilizers 40 ensure that first shaft 30, second shaft 34 and motor base plate 38 are always in alignment with one another. In one implementation, stabilizers 40 encompass position sensor 31 and electronic contact device 33 at the top. Position sensor 31 reads the sensors located along track 18 and detects location of the shuttle 22 and user 20 along track 18. In addition, sliding mechanism 22 includes motor 42 that rests on motor base plate 38 with support from second shaft 34 via differential drive 41. FIG. 4 shows the feature of motor 42 resting on motor base plate 38 with support from second shafts 34 and 35 via differential drive 41. In the present embodiment, motor 42 operates and drives second shaft 34 which in turn drives second geared wheels 36 in forward or rearward direction. In addition, sliding mechanism 22 includes third shaft 44 that mounts parallelly to first shaft 30, second shaft 34 and motor base plate 38 (FIGS. 3 and 4). Third shaft 44 mounts to lift motor 46. Third shaft 44 includes lift strap 48 (part of lifting yoke 24). Lift strap 48 extends and wounds around third shaft 44 when lift motor 46 rotates third shaft 44 to raise or lower user and to adjust tension and support. In one implementation, shuttle 22 includes first lift strap sensor 45 and second lift strap sensor 47. First lift strap sensor 45 positions at the bottom of lift motor 46. In other words, first lift strap sensor 45 mounts underside of lift motor 46. Lift strap 48 encompasses one or more second lift strap sensors 47, as shown in at least FIG. 4. First lift strap sensor 45 receives data from one or more second lift strap sensors 47 and determines the vertical position/location of user 20, at any given point of time.

Figure 5:
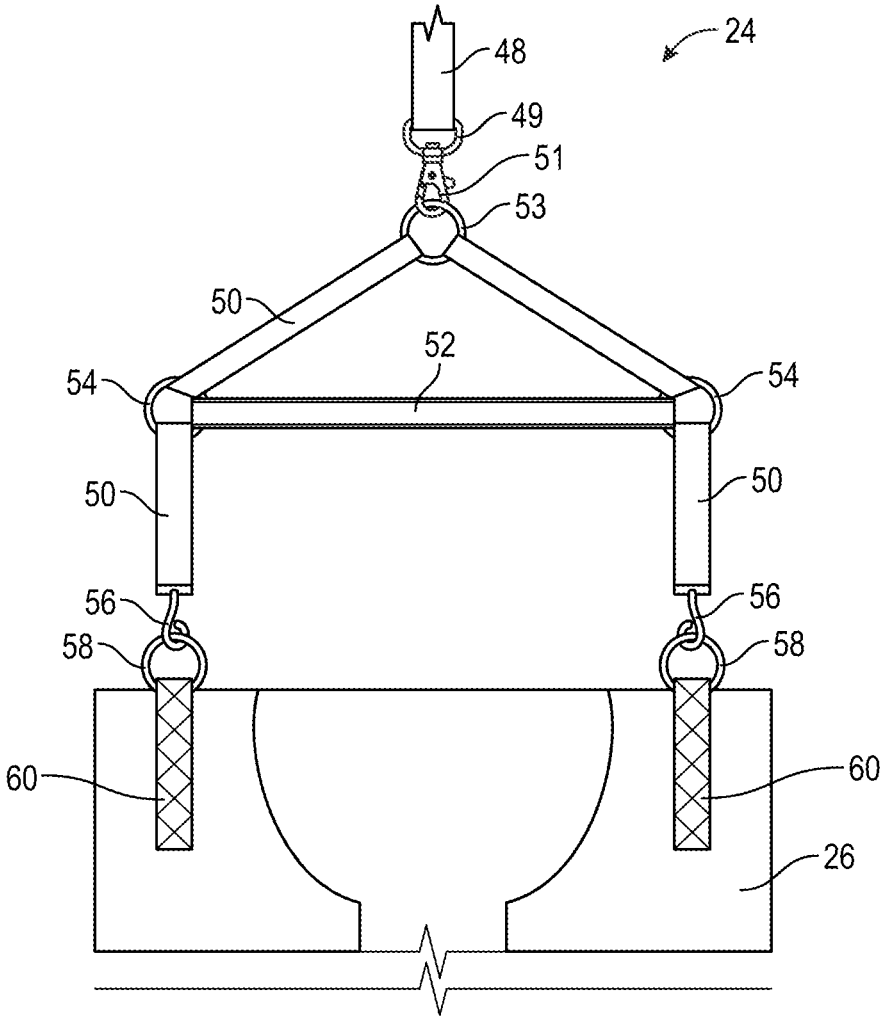
FIG. 5 illustrates a front view of a strap hanging arrangement change drawing to include swivel.
Figure 6:
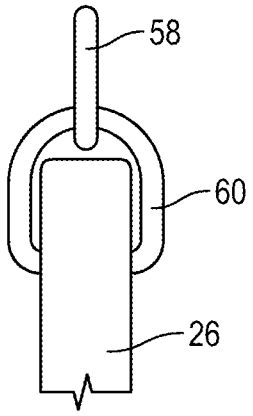
FIG. 6 illustrates a side view of first vest straps connecting balance rings.

FIG. 5 shows a front view of lifting yoke 24, in accordance with one exemplary embodiment of the present invention. Strap hanging arrangement 24 includes lift strap 48. Lift strap 48 presents support straps 50 spaced with the help of space bar 52. Padded space bar 52 provides a material made of strong lightweight plastic, or any other suitable material. Space bar 52 allows to keep support straps 50 at a distance such that support straps 50 are away from user's head and can connect to vest 26 worn by mobility-impaired individual 20 at his/her shoulder area. In one implementation, lift strap 48 connects to lifting yoke 24 with the help of swivel 49, snap latch 51 and strap rings 54. Swivel 49 prevents lift strap 48 from tangling and also provides 360-degree freedom of directional movement for the user. Snap latch 51 provides connection of lift strap 48 and swivel 49 to lifting yoke 24 at strap ring 53. Strap rings 54 allow support straps 50 to suspend freely from lift strap 48 such that mobility-impaired individual 20 will be able to move freely hanging with support from vest 26. Each of support straps 50 presents snap latch 56 at the end. Snap latch 56 allows to mount balance ring 58 that helps to connect support straps 50 to vest 26. Here, first vest straps 60 of vest 26 connect to balance rings 58. FIG. 6 shows a side view of first vest straps 60 connecting balance rings 58, in accordance with one exemplary embodiment of the present invention. Balance rings 58 allow back and forth movement of mobility-impaired individual 20 while wearing vest 26 such that mobility-impaired individual 20 will be able to tilt body forward and backward and not have motion strain on neck and head.

Figure 7:
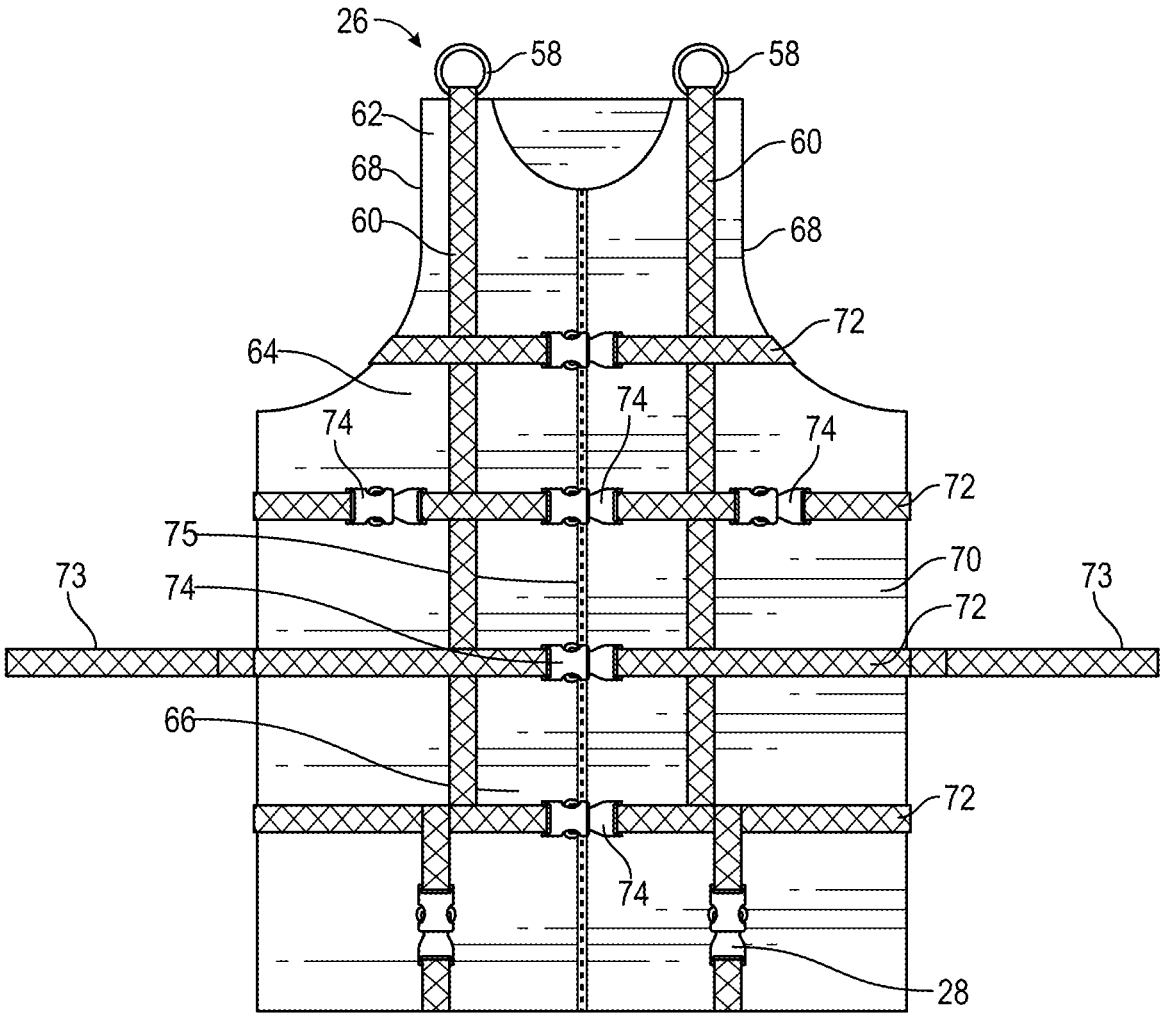
FIG. 7 illustrates a front view of a vest.

As specified above, balance rings 58 connect to first vest straps 60 of vest 26. FIG. 7 shows a front view of vest 26. Vest 26 includes first vest padded straps 60 that mount in a vertical configuration. Vest 26 encompasses shoulder portion 62, chest portion 64 and torso portion 66. Shoulder portion 64 encompasses sleeve region 68. Vest includes padded and ventilated portion 70 that extends shoulder portion 62, chest portion 64 and torso portion 66 to provide a cushion effect to mobility-impaired individual 20. Vest 26 includes (one or more) second vest padded straps 72, each spaced at equal or varied distance depending on the need. Second vest enclosure straps 72 mount in a horizontal configuration i.e., perpendicularly to first vest straps 60. This is done by design, so that the lifting force supporting the weight of the user is distributed across the vest through the vertical straps 60 and not transferred directly to the enclosure straps 72, thereby reducing and preventing vest tightening which would cause discomfort and restrict breathing. Additionally, vest 26 encompasses arm positioner straps 73. Arm positioner straps 73 connect to second vest padded straps 72 and help to secure user's arms close to their chest and torso. Securing user's arms helps in preventing user 20 with cognitive impairment (such as dementia) from possibly raising arms and getting them entangled with the lifting yoke assembly 24. In one implementation, each of first vest straps 60 and/or second vest straps 72 encompasses buckle mechanism 74. Buckle mechanism 74 helps to tighten vest 26 around the body of mobility-impaired individual 20 during use. In one alternate embodiment, arm positioner straps 73 are secured with buckle mechanism 74. In one example, vest 26 encompasses zipper 75 that runs entire length of vest 26. Zipper 75 allows user to put on or remove vest 26 easily. At the bottom, vest 26 presents leg support mechanism 28.

In addition, vest 26 includes one or more pockets (not shown) for storing daily-used items or other items depending on the need. Alternatively, vest 26 includes a pocket that receives a control box or remote controller (not shown) used for controlling the operation of system 12.

Figure 8:
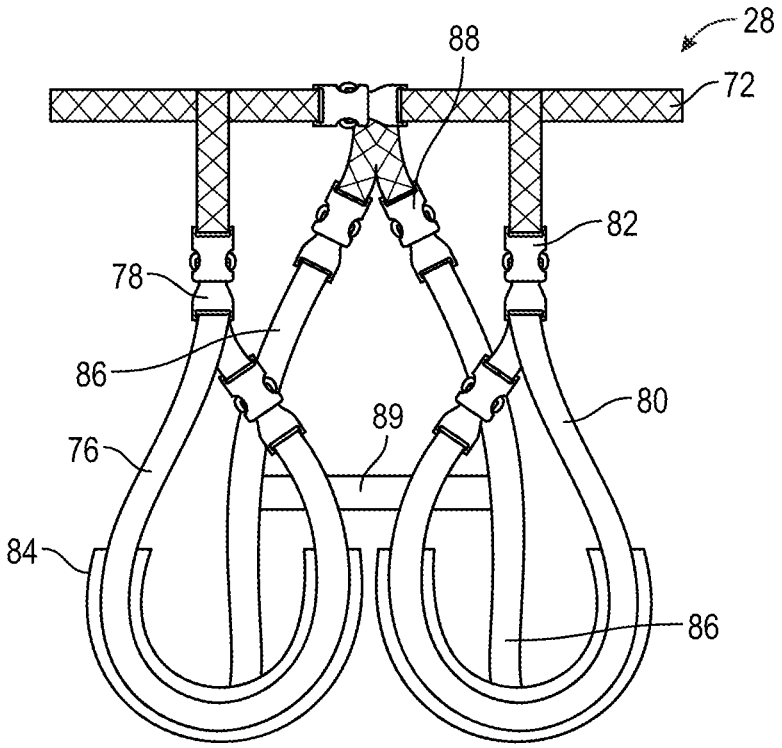
FIGS. 8 and 9 illustrate a front and a rear view, respectively of a leg support mechanism.
Figure 9:
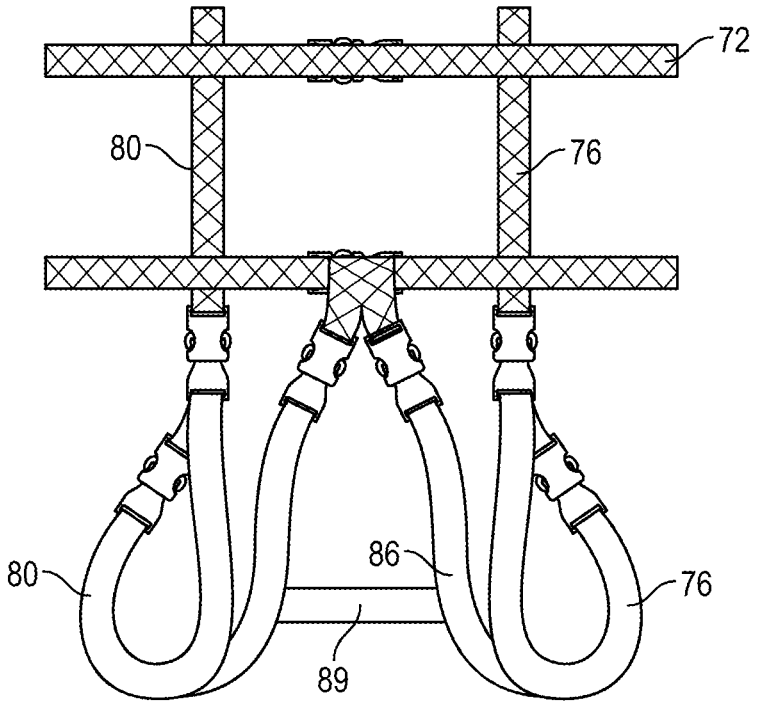

FIGS. 8 and 9 show a front and a rear view of leg support mechanism 28, respectively. Leg support mechanism 28 includes first leg strap 76 having buckle mechanism 78. Second leg strap 80 includes buckle mechanism 82. Each of first leg strap 76 and second leg strap 80 connect and extend from second vest straps 72. In accordance with the present embodiment, first leg strap 76 and second leg strap 80 receive legs of mobility-impaired individual 20 and allow to take support or suspend with the help of sliding mechanism 22, strap hanging arrangement 24 and vest 26. In one implementation, first leg strap 76 and second leg strap 80 help mobility-impaired individual 20 to position in a sitting posture with the help of sliding mechanism 22, strap hanging arrangement 24 and vest 26. In one implementation, leg support mechanism 28 encompasses connecting strap 84 that connects first leg strap 76 and second leg strap 80. Connecting strap 84 goes through the legs of mobility-impaired individual 20 and provides support from the back of mobility-impaired individual by providing somewhat of a seat strap arrangement 20. In one example, first padded leg strap 76 and/or second padded leg strap 80 present pad 86. Pad 86 provides comfort for the mobility-impaired individual 20 while in use and prevents him from getting injured due to the stiffness of first padded leg strap 76 and/or second padded leg strap 80. In one example, connecting strap 84 includes buckle mechanism 88 for adjusting the length depending on the need. In addition, pad 86 includes padded seat support strap 89. Seat support strap 89 supports mobility-impaired individual 20 when in use.

Figure 10:
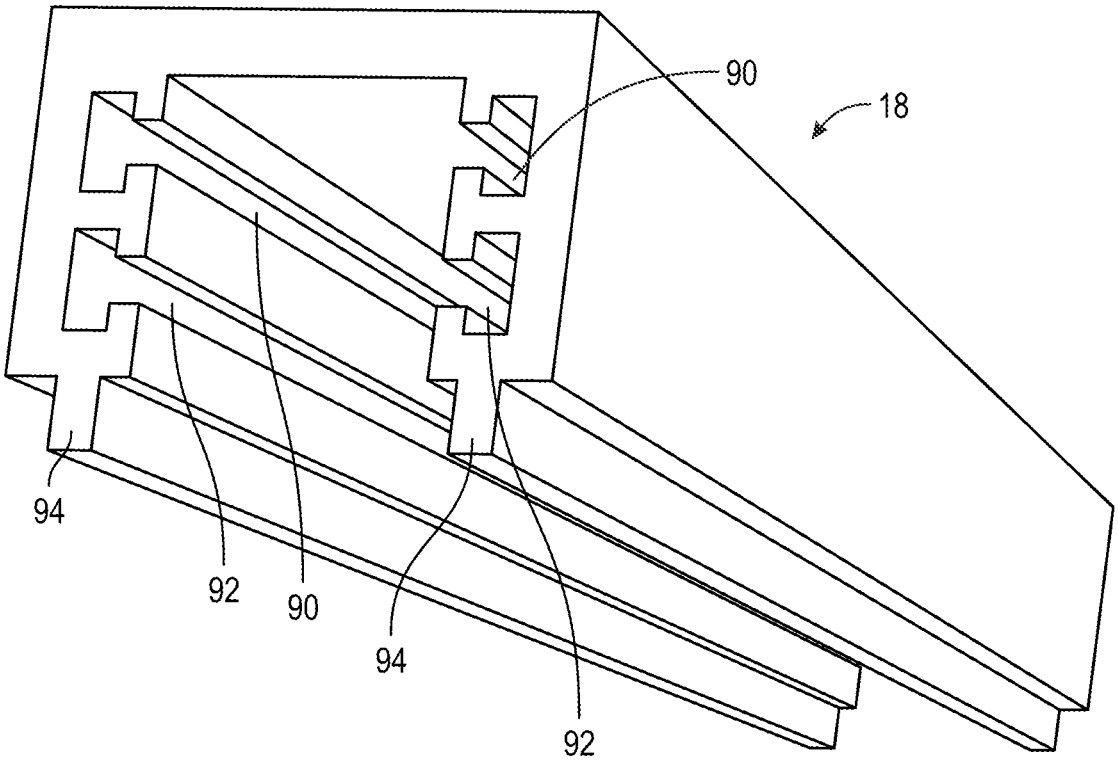
FIG. 10 illustrates a short section of track.

As specified above, sliding mechanism 22 connects and suspends from track 18 that is mounted at 14 of structure 16. FIG. 10 shows the feature of track 18, in accordance with one embodiment of the present invention. As specified above, track 18 comes in a variety of configuration including vertical or horizontal curvature depending on the need. Track 18 encompasses first rails 90 and second gear grooved rails 92. First rails 90 and second gear grooved rails 92 indicate elongated slots in track 18 that run the entire length of track 18 in parallel. First rails 90 and second gear grooved rails 92 receive first wheels 32 and second geared wheels 36, respectively. In other words, first wheels 32 draw through first rails 90. Similarly, second geared wheels 36 draw through second gear grooved rails 92. Track 18 further encompasses lower support beams 94. Lower support beams 94 provide additional vertical and horizontal load support and allow the rest of the overall track to be less robust, thereby reducing the size of track 18 and making it less invasive to the home and more aesthetically pleasing. Track 18 encompasses positional indicators or sensors installed along track 18 (not shown) that provide the location of the user along track 18. The positional indicators help to determine the location of support system 22 along track 18 at any given point of time. In one example, the positional indicators transmit the location information of support system 22 to caretaker's mobile phone such that the care taker is made aware of the support system's location. Track 18 encompasses a power strip (not shown) that supplies power to motors 42 and 46. Optionally, track 18 includes a battery charging system (not shown) to ensure mobility and support system 22 maintains power if electricity connection is lost.

Upon connecting sliding mechanism 22 to track 18, strap hanging arrangement 24 connects to sliding mechanism 22 i.e., lift strap 48 connects to third shaft 44. Further, vest 26 connects to strap hanging arrangement 24. Further, leg support mechanism 28 connects to vest 26. FIG. 2 shows the feature of sliding mechanism 22 connecting strap hanging arrangement 24, which in turn connecting vest 26, which in turn connecting leg support mechanism 28.

Figure 11A:
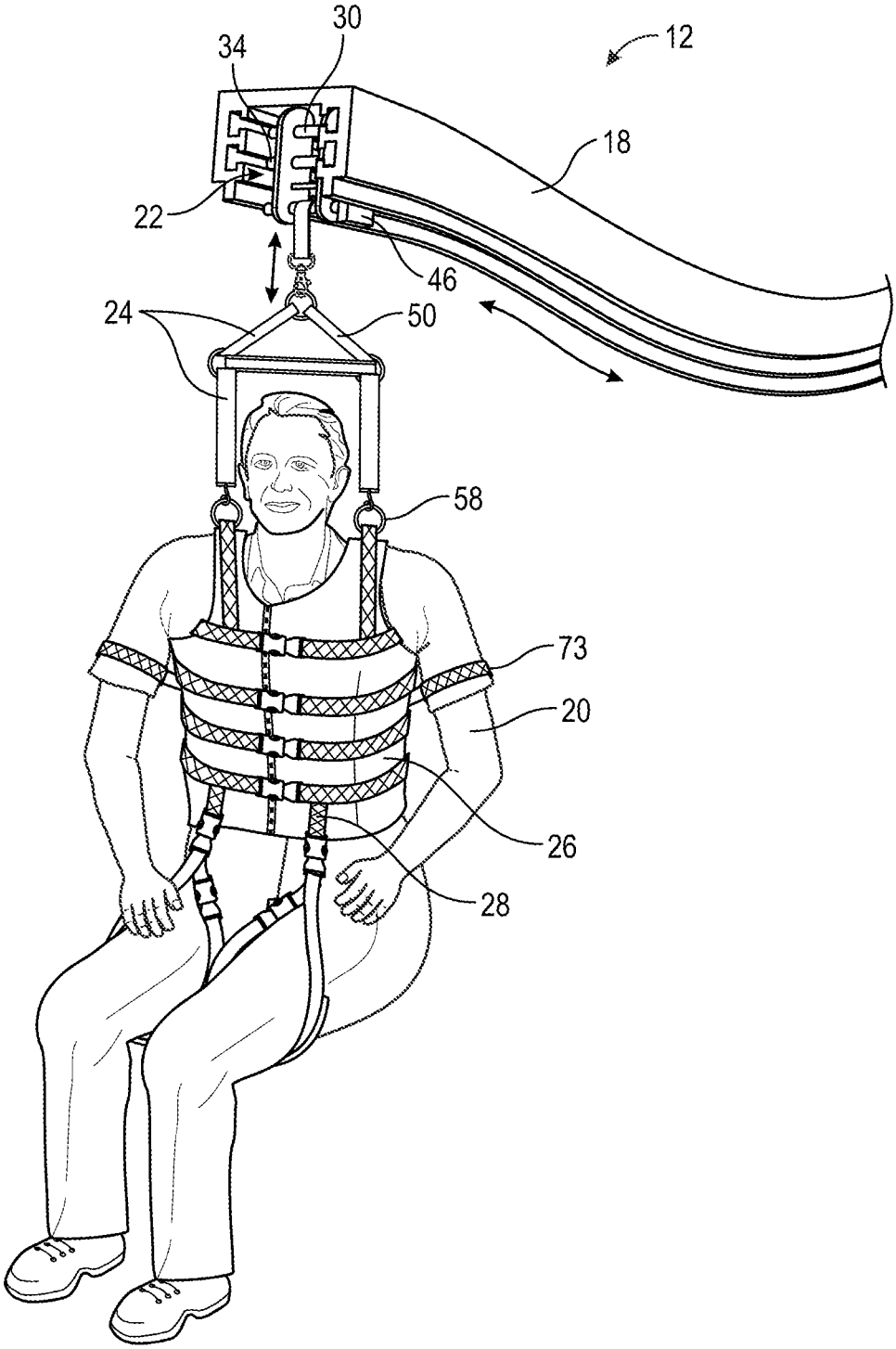
FIGS. 11A and 11B illustrate operational features of the system, in accordance with one exemplary embodiment of the present invention.
Figure 11B:
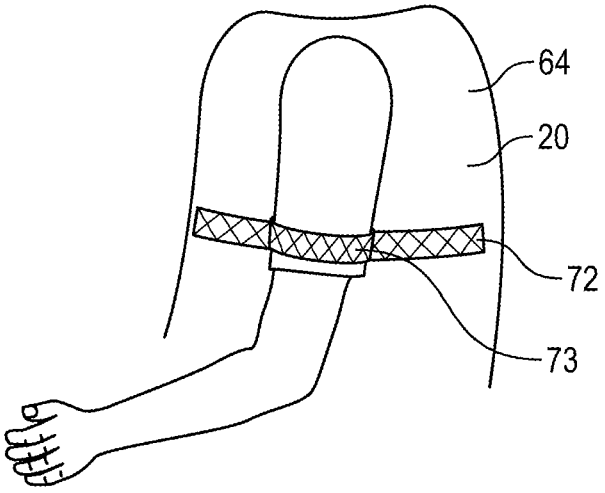

Now referring to FIGS. 11A and 11B, operational feature of the system 12 is explained. At first, track 18 mounts to ceiling 14. Subsequently, sliding mechanism 22 connects to track 18. Further, strap hanging arrangement 24 connects to sliding mechanism 22. Further, vest 26 connects to strap hanging arrangement 24. Further, leg support mechanism 28 connects to vest 26. Upon connecting system 12, a caretaker helps mobility-impaired individual 20 to put on vest 26 and leg support mechanism (or the individual does it if they can stand and use arms, hands) 28. Subsequently, the caretaker tightens second vest straps 72, first leg strap 76 and second leg strap 80. (or the individual does it if they can use arms, hands)

Depending on whether mobility-impaired individual 20 wishes to move around in structure 16 in a sitting or standing position, the caretaker (or individual) adjusts the height of system 12. In order to adjust the height of system 12, the individual (or caretaker) operates lift motor 46 that extends (for sitting position) or wounds (for standing position) lift strap 48 around third shaft 44. In one example, the individual (or caretaker) operates a switch on control box or remote controller (not shown) provided at lift motor 46 to control the length of lift strap 48 which in turn controls the extent (vertical position) of vest 26 and leg support mechanism 28. In another example, the individual (or caretaker) operates lift motor 46 using a remote controller (not shown, wired or wireless controller) to control the length of lift strap 48 which in turn controls the extent (vertical position) of vest 26 and leg support mechanism 28 suspends from 14. Further, the individual (or caretaker) operates motor 42 using a manual switch or a remote controller. Upon operating, motor 42 drives second shaft 34, which in turn drives second geared wheels 36 along second gear grooved rails 92. This drives sliding mechanism 22 forward or backward. Here, second geared wheels 36 help to maneuver sliding mechanism 22 and in turn system 12 suspending mobility-impaired individual 20 via vest 26 and leg support mechanism 28. As second geared wheels 36 drive system 12 along track 18, first wheels 32 bear the weight of whole system 12 and mobility-impaired individual 20.

In one example, mobility-impaired individual 20 or the caretaker operates motor 42 to move system 12 along track 18 around structure 16 e.g., between rooms either in sitting position (FIG. 11) or standing position (FIG. 1) with a wired or wireless/remote controller. Further, mobility-impaired individual 20 or the caretaker operates lift motor 46 to adjust height of system 12 by extending or wounding lift strap 48 with the help of a wired or wireless/remote controller. FIG. 11B shows a side view of the arm positioner straps 73 located on vest 26. The straps 73 attach to vest straps 72 and are adjusted using buckle mechanism 74 to position the users' arms in a downward and close to the body position. This keeps the users' arms down and away from the overhead strap hanging assembly and also keeps the vest from being pulled off of the user if the leg straps are not being utilized.

Figure 12:
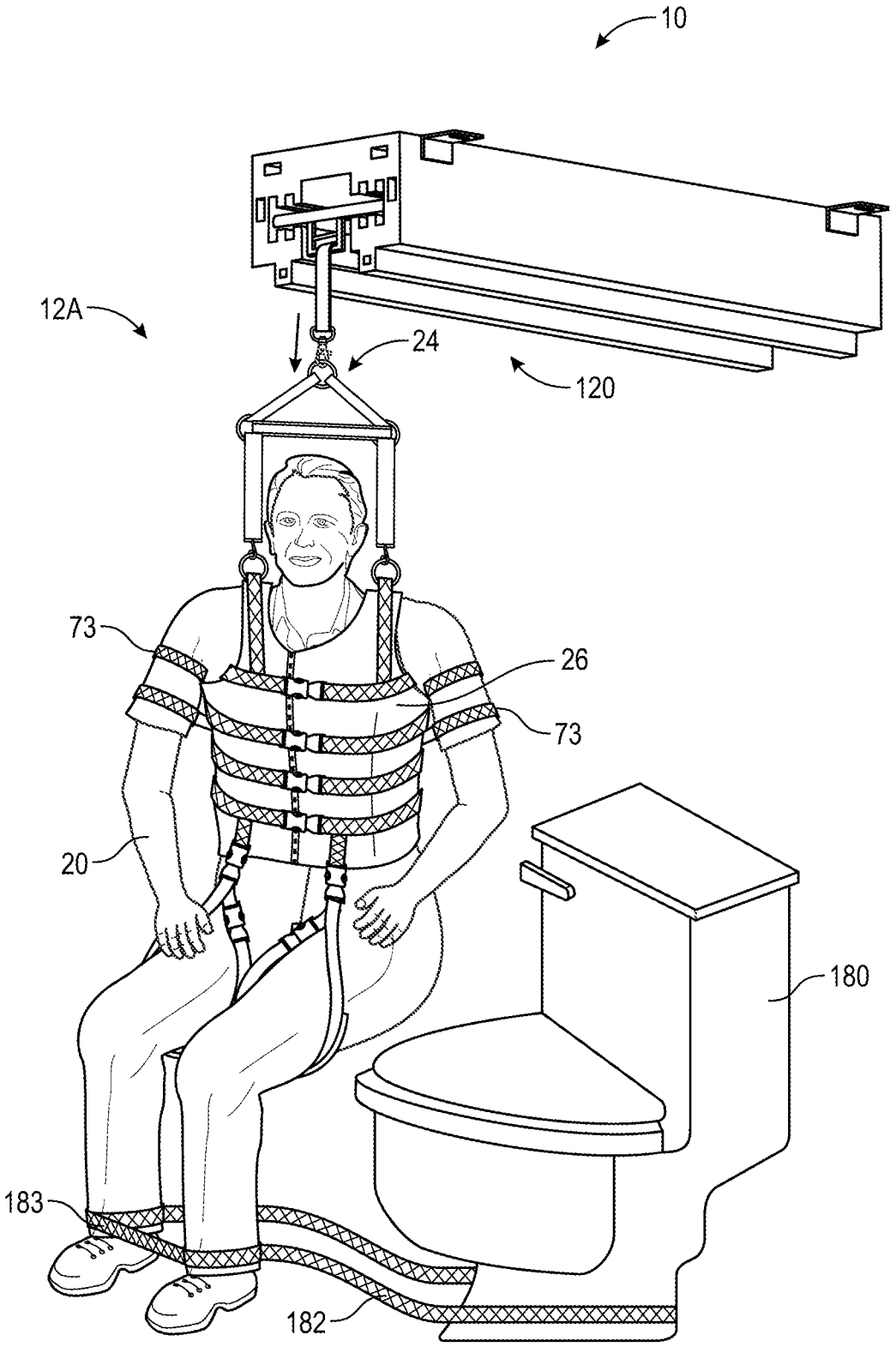
FIG. 12 illustrates an environment of the system for assisting the mobility-impaired individual, in accordance with another embodiment of the present invention.

Now referring to FIGS. 12 through 21, an alternate system 12 in which a different (single axle) shuttle 100 and single axle track 120 is used to move the user 20 from one place to another is explained, in accordance with another embodiment of the present invention. FIG. 12 shows environment 10 in which shuttle 100 is used to move the user 20 from one place to another. Specifically, FIG. 12 shows a feature in which single axle shuttle 100 has replaced dual axle shuttle 22 explained using FIG. 1, for example. Here, user or impaired individual 20 is shown using system 12 for toilet needs. As can be seen, user 20 is shown in relation to toilet 180, whereby once user 20 is in desired position, whether standing in front of toilet 155 or sitting on toilet 180, straps and/or ankle/leg enclosure bands 182 are used to secure him relative to toilet 180. For instance, straps and/or ankle/leg enclosure bands 182 are placed around toilet 180 and secured around the individuals' ankles/legs. Straps and/or ankle/leg enclosure bands 182 are adjusted using adjustment feature (buckle, Velcro™, snap or similar), so that the individuals' proximity to the toilet is secured. Band 182 is then attached to straps 183 using the loop rings on the ankle straps and the adjustment feature (buckle, Velcro™, snap or similar), so that the spacing of the individuals' feet is at a comfortable position while preventing the legs and feet from becoming widely spaced.

Figure 13:
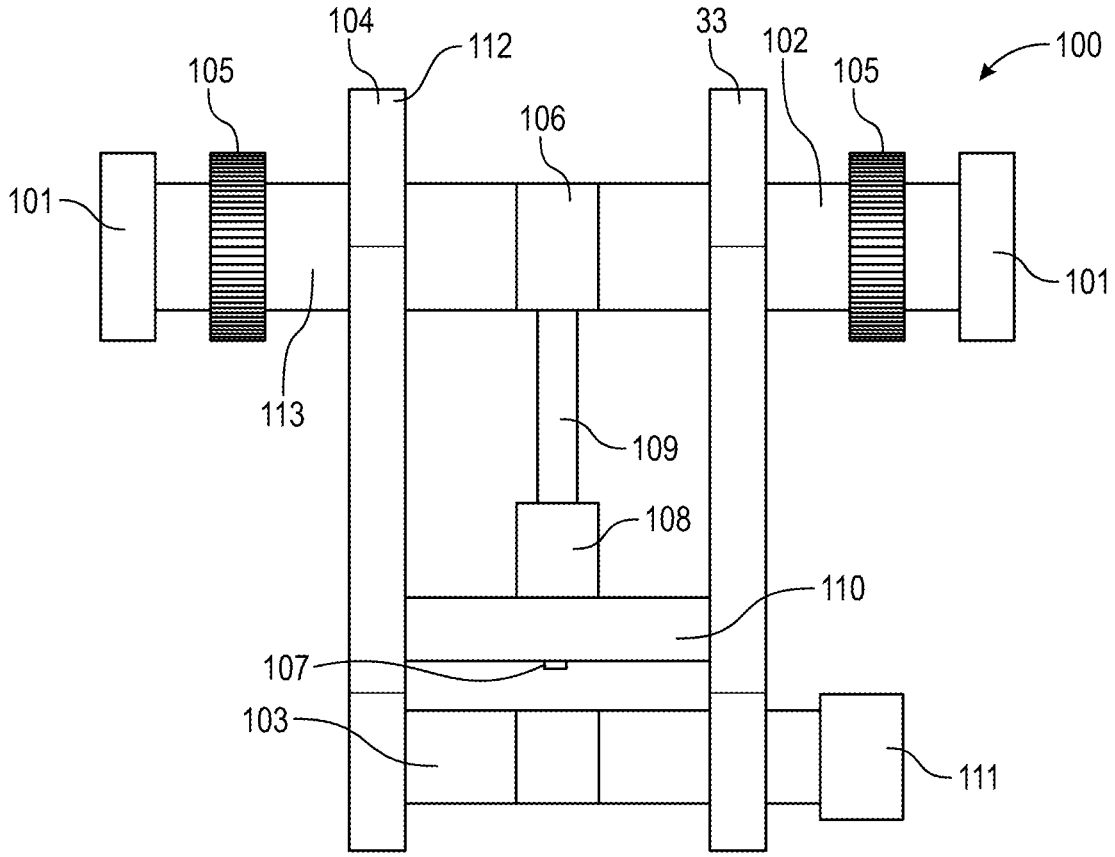
FIG. 13 illustrates a front view of a single axle shuttle, in accordance with one embodiment of the present invention.

FIG. 13 shows a front view of single axle shuttle 100, in accordance with one embodiment of the present invention. Here, single axle shuttle 100 acts as a sliding mechanism that travels through single axle track 120 and helps user to navigate from one place to another as explained above. Shuttle 100 provides a material made of metal, hard plastic, wood or any other suitable material. Shuttle 100 includes shafts 102 and 113 having first wheels 101 for load support and second geared wheels 105 for gear driven movement forward or backward. Shafts 102 and 113 come in a cylindrical configuration. Shafts 102 and 113 act as a single weight bearing shaft that withstands the entire weight of system 12 and mobility-impaired individual 20. Shafts 102 and 113 also act as a gear drive shaft that helps to drive system 12 in forward or rearward direction along track 120. In accordance with present subject matter, first wheels 101 act as load supporting wheels. Second geared wheels 105 indicate gear drive wheels. Shafts 102 and 113 draws through stabilizers 104. Stabilizers 104 connect to motor base plate 110 and lifting axle or second shaft 103 in parallel to each other. Stabilizers 104 ensure that shafts 102 and 113, motor base plate 110 and lifting axle 103 are always in alignment with one another. In one example, motor base plate 110 comes in a rectangular configuration. Base plate 110 has lift strap position sensor 107 mounted on the bottom of the plate. Sensor 107 reads the strap position sensors 47 located along lifting strap 48 Additionally, shafts 102 and 113 encompass a differential drive unit 106. Differential drive unit 106 connects to drive motor 108 mounted to the top side of motor base plate 110. Drive shaft 109 is driven by motor 108 and powers differential drive 106. Lifting axle or second shaft 103 includes lift axle drive motor 111. Additionally position sensor 31 and electronic contact device 33 are located at the top of the shuttle stabilizers.

In the present embodiment, drive motor 108 operates and drives drive shaft 109, which drives differential drive unit 106 which drives shaft 102 which in turn drives second geared wheels 105 in forward or rearward direction. Lifting axle or second shaft 103 includes lift strap (similar to lift strap 48 which is part of lifting yoke 24). Lift strap extends and wounds around lifting axle 103 when lift axle drive motor 111 rotates lifting axle 103 to raise or lower user and to adjust tension and support. Shuttle 100 includes position sensor 112 at the top of stabilizers 104 to read sensors on track 120. Shuttle 100 includes a lift strap position sensor that mounts underside of motor base plate 110. Lift strap has multiple position sensors 47 incorporated so that the sensor 107 can read them to determine the vertical location (position) of the user.

Figure 14A:
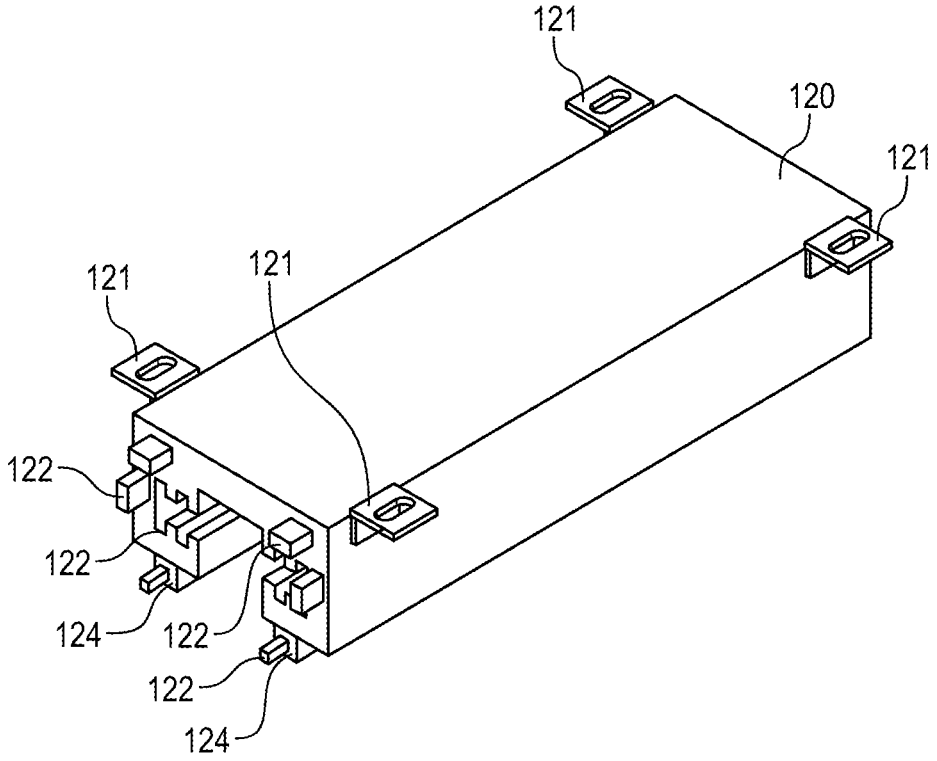
FIGS. 14A, 14B, and 14C illustrate perspective views of a single axle shuttle track, in accordance with one embodiment of the present invention.
Figure 14B:
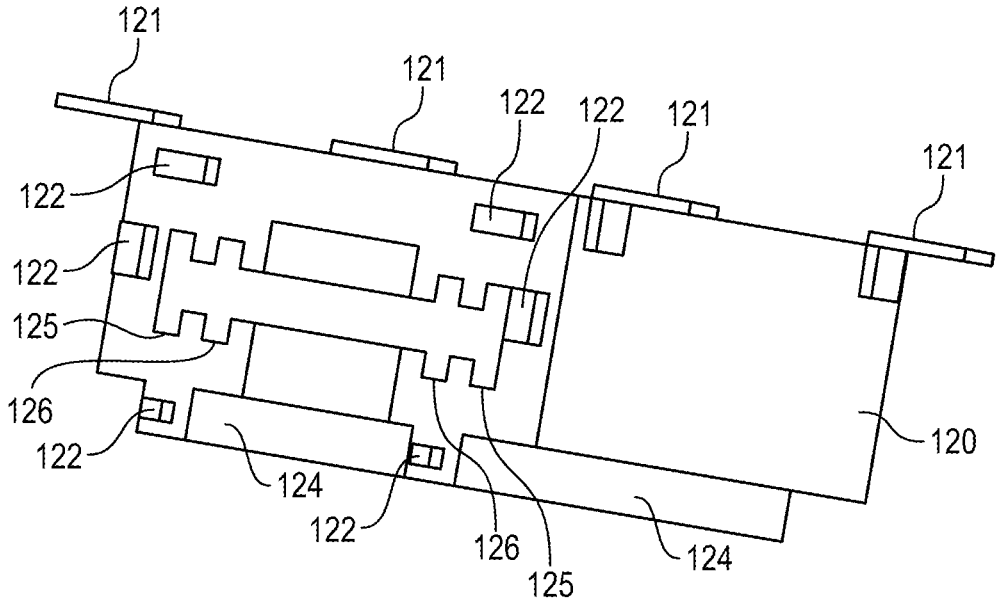
Figure 14C:
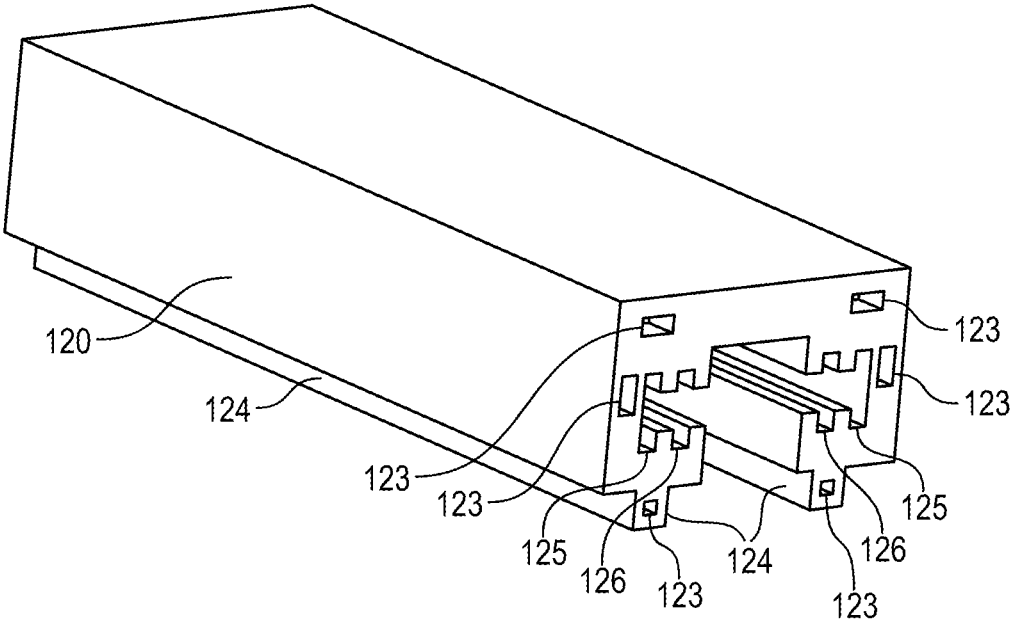

FIGS. 14A, 14B, and 14C show perspective views of track 120 that allows shuttle 100 to travel along its path, in accordance with one embodiment of the present invention. Specifically, FIG. 14A shows a section of support track 120 for a single axle shuttle 110. Track 120 comes in a variety of configurations including vertical or horizontal curvature depending on the need. Track 120 includes connectors 121 located along track 120 at the top at uniform or desired spacing are to secure the track to the ceiling or overhead mounting surface 14. In one example, track 120 suspends from the ceiling 14 or overhead mounting surface 14 using connectors 121 and adjustable brackets or strut type of devices to secure the track in the preferred vertical and horizontal position. Track 120 encompasses pin connectors 122 that slide into track connector pin pockets 123. FIG. 14C shows the track connector pin pockets 123 positioned on track 120 to connect track sections and track connector ends so that the track is stable and secure in supporting the user and loads. Pin connectors 122 slide into track connector pin pockets 123 to connect track sections and track connector ends 159 so that the track is stable and secure in supporting the user and loads.

Track 120 encompasses first smooth rails 125 and second gear grooved rails 126, as shown in FIG. 14B. First smooth rails 125 and second gear grooved rails 126 indicate elongated slots in track 120 that run the entire length of track 120 in parallel. First smooth rails 125 and second gear grooved rails 126 receive first wheels 101 and second geared wheels 105, respectively. In other words, first wheels 101 draw through first rails 125. Similarly, second geared wheels 105 draw through second gear grooved rails 126. Grooved Rails 126 have grooved surface on the bottom of the section but not on the top. Track 120 further encompasses lower support beams 124. Lower support beams 124 provide additional vertical and horizontal load support and allow the rest of the overall track to be less robust, thereby reducing the size of track 120 and making it less invasive to the home and more aesthetically pleasing. Track 120 encompasses positional indicators or sensors installed along track 120 (not shown) that provide the location of the user along track 120.

As specified above, position sensor 112 is located near the top of shuttle 100 to read the track sensors on track 120. The positional indicators help to determine the location of support system i.e., shuttle 100 along track 120 at any given point of time. In one example, the positional indicators transmit the location information of support system to caretaker's mobile phone such that the care taker is made aware of the support system's location. Track 120 encompasses a power strip (not shown) that supplies power to motors 108, 111, and 163. Optionally, track 120 includes a battery backup system (not shown) to ensure mobility and support system i.e., shuttle 100 maintains power if electricity connection is lost. Upon connecting sliding mechanism/shuttle 110 to track 120, as shown in FIG. 12, for example, strap hanging arrangement 24 connects to sliding mechanism 100 i.e., lift strap 48 connects to lifting axle 103. Further, vest 26 connects to strap hanging arrangement 24. Further, leg support mechanism 28 connects to vest 26.

Figure 15:
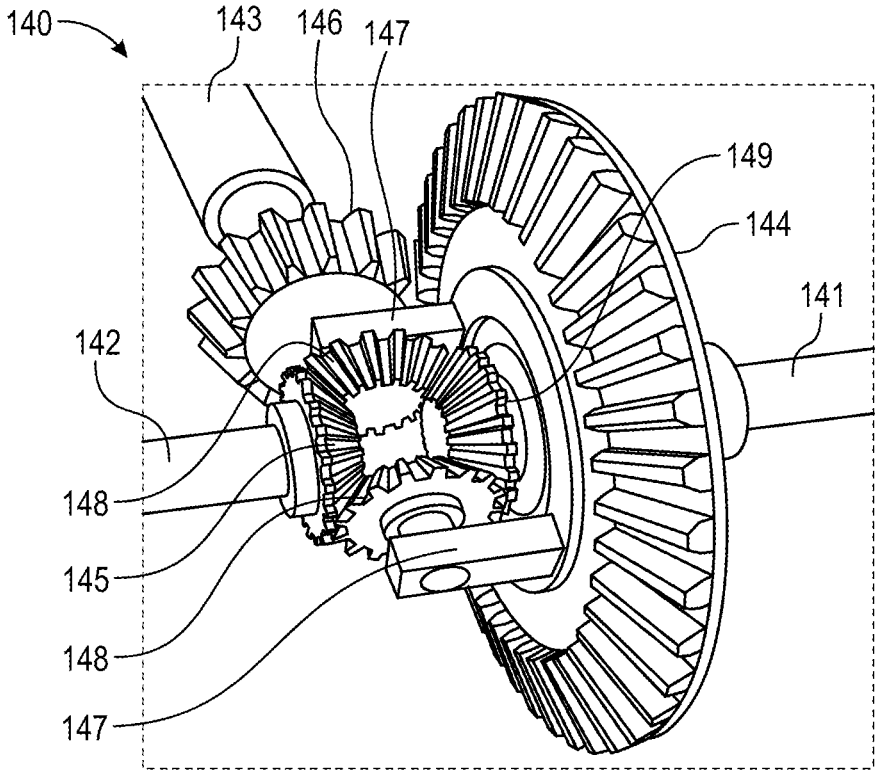
FIG. 15 illustrates a differential drive mechanism that powers the shuttle moving along the track, in accordance with one embodiment of the present invention.

FIG. 15 shows a differential drive mechanism 140 that powers shuttle 100 moving along track 120, in accordance with one embodiment of the present invention. A person skilled in the art understands that the components of differential drive mechanism 140 may present an open, locked differential, limited slip differential, or any type that provides safe movement along the support track. A motor powers differential drive axle 143 which has pinion gear 146 at the end of the drive shaft. Pinion gear 146 meshes with ring gear 144 which is mounted on first axle shaft 141. First axle side gear 149 is mounted on ring gear 144. First axle side gear 149 meshes with spider gears 148 which are mounted on supports 147 which are mounted on ring gear 144. Spider gears 148 mesh with second side gear 145, mounted on second axle shaft 142. This system of gears enables shaft 102 to rotate at different speeds than shaft 113 when traversing horizontally curving sections of track. Therefore, the shuttle load support wheels 101 and gear drive wheels 105 which are mounted on shaft 102 to turn at different speeds than load support wheels 101 and gear drive wheels 105 which are mounted on shaft 113 on horizontally curving surfaces. More than two spider gears 148 may be used to engage axle gears 149 and 145. These additional gears strengthen the design as the torque load is distributed across a greater number of gear surfaces.

Figure 16A:
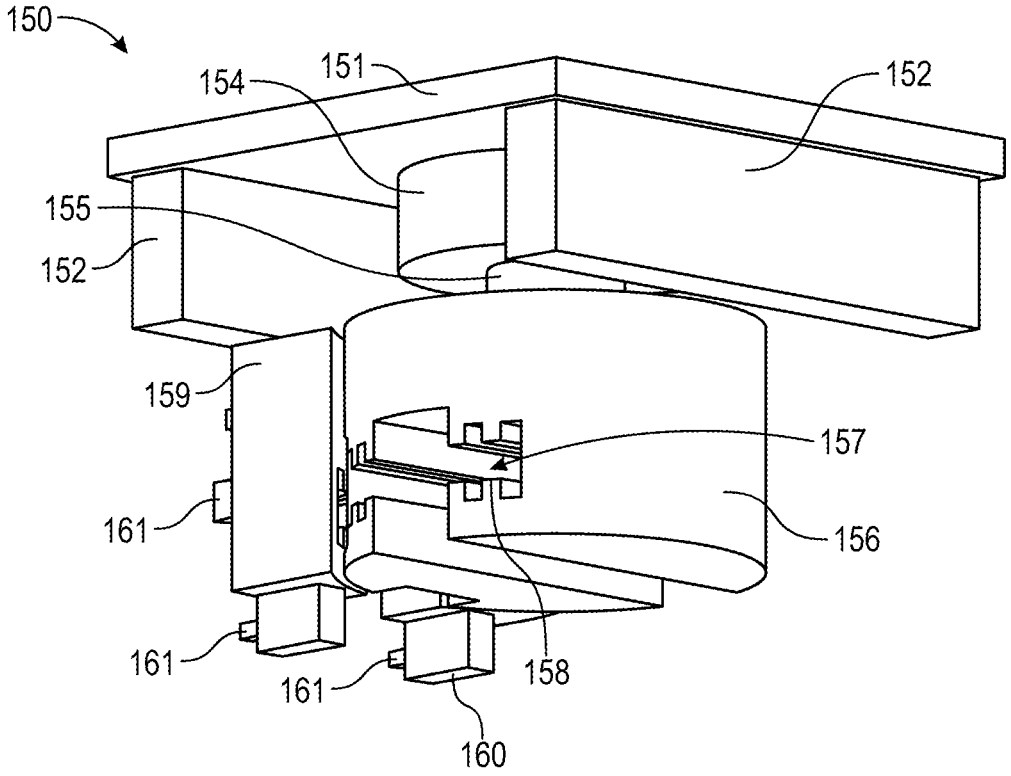
FIGS. 16A and 16B illustrate a perspective view and a front view, respectively of a track turntable, in accordance with one embodiment of the present invention.
Figure 16B:
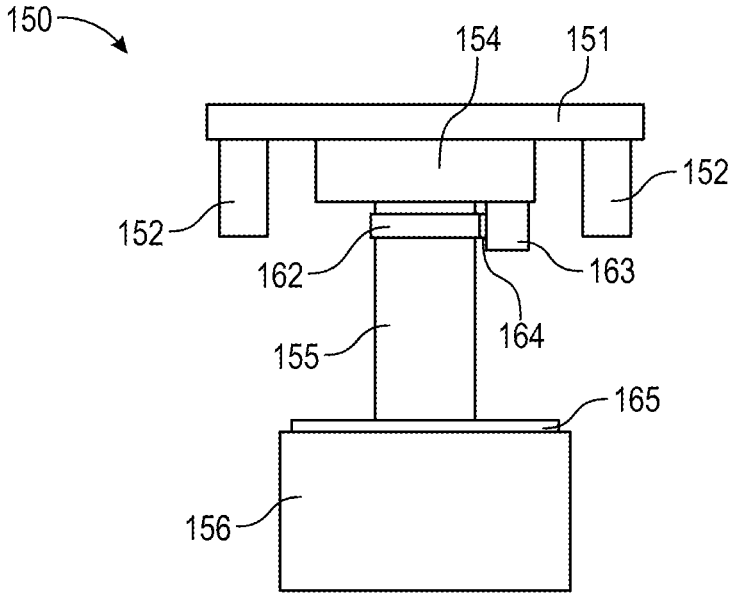

Shuttle 100 operates in conjunction with a track turntable 150. FIGS. 16A and 16B show a perspective view and a front view, respectively of track turntable 150, in accordance with one embodiment of the present invention. Here, track turntable 150 connects to track 120 using track connector ends 159. Track turntable 150 mounts to the ceiling 14 or overhead support by ceiling mounting plate 151. Track connector ends 159 are mounted on track end mounting plates 152 which are attached to ceiling mounting plate 151. Track connector ends 159 have connector pins 161 with identical profile as on track 120 end track connector pin pockets 123, to lock the track sections together as one piece. Track connector ends 159 also have support beams 161 at the bottom with the same profile as track 120 to lock the track sections together as one piece. Ceiling mounting plate 151 includes bearing housing 154. Bearing housing 154 is mounted to the underside of ceiling mounting plate 151. FIG. 16B shows the positioning of bearing housing 154 connected to ceiling mounting plate 151 which connects to ceiling or overhead support structure 14. Axle gear ring 162 is located on load axle 155 in alignment with rotational drive gear 164 and motor 163. Motor 163 is mounted to the underside of bearing housing 154. Rotating section 156 connects to load axle 155 by using mounting plate 165. Connector end mounts 152 are also shown connected to ceiling mounting plate 151. The weight of turntable section 120, individual, and all components moving through it, are supported by the ceiling mounting plate 151 and whatever surface it is attached to. The weight is also supported by track sections 120 that connect to the track connector ends 159 mounted to supports 152 on turntable section 150.

Figure 17:
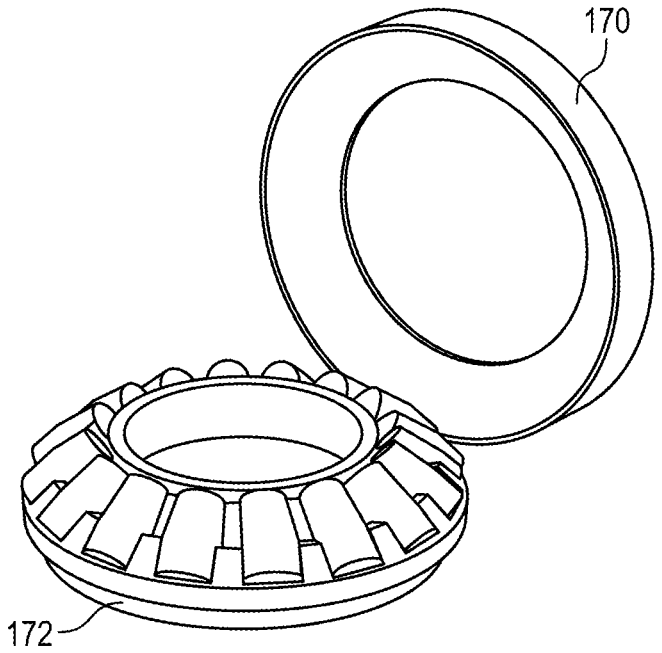
FIG. 17 illustrates a turntable weight bearing axle cap and rotational load bearings, in accordance with one embodiment of the present invention.

Bearing housing 154 contains rotational load/tapered bearings 172 (FIG. 17). Bearing housing 154 encompasses turntable axle 155 having axle cap 170 at the top of the axle, and is connected to the turntable rotating section 156 at the bottom end by turntable mounting plate 165. Turntable axle 155 extends through the center of rotational load bearings 172. Axle cap plate 170 (FIG. 17) has a profile that matches rotational load bearings 172 profile so that the load is distributed across the rotational load bearings 172 as evenly as possible.

FIG. 17 shows a tapered ball bearing 172 design used to support individual 20 while moving onto and through the turntable section 150. Tapered bearings 172 provide excellent vertical and horizontal support while the load they support is being suspended and rotated. The axle cap 170 is shown without attachment to the axle 155. The axle cap 170 is the top part of axle 155 and the axle cap 170 profile matches with the tapered bearing 172 profile to evenly distribute the weight on top of the bearings.

Figure 18:
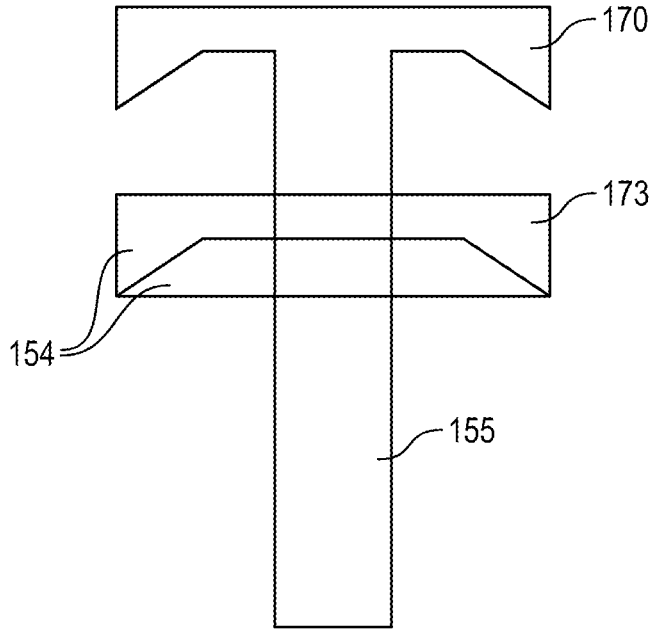
FIG. 18 illustrates a side view of the axle cap, the axle, and a bearing housing, in accordance with one embodiment of the present invention.

FIG. 18 shows a side view of axle cap 170, axle 155, and bearing housing 174. Axle cap 170 has a profile that matches bearing profile 173 to evenly distribute the weight on top of the bearings. The axle cap 170 underside contacts bearing 172 and the load is applied on top of the bearings. The cap is shown in place inside bearing housing 154 and you can see that bearing 172 profile is the same as axle cap 170 profile. The axle 155 and axle cap 170 are also shown in an up position where you see axle cap 170 profile alone and is same as seen in the down position in bearing housing 154.

Figure 19:
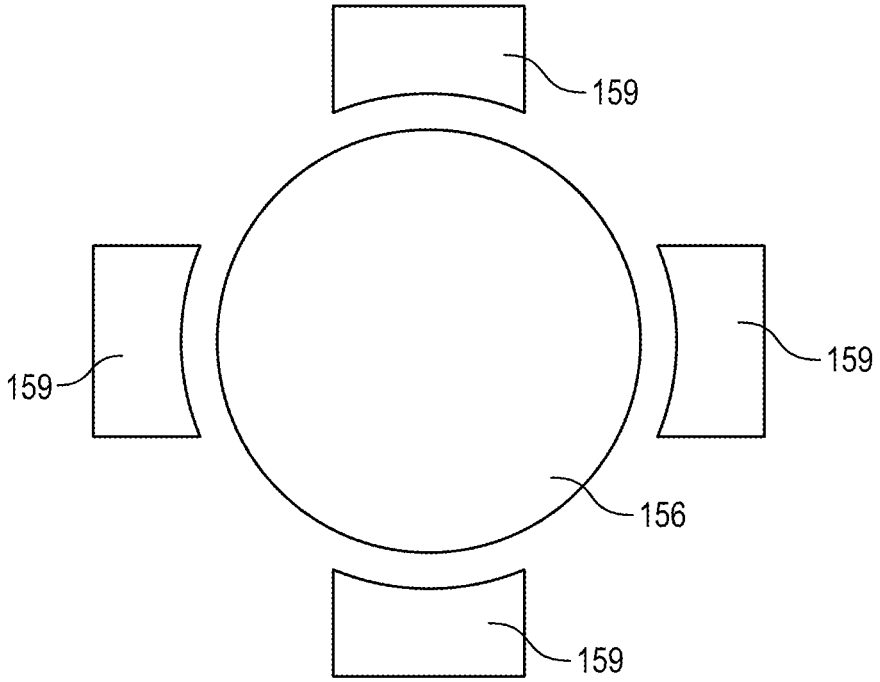
FIG. 19 illustrates a top view of the positioning of the turntable rotating section, and track connector ends for an intersection where two tracks intersect at 90 degrees in accordance with one embodiment of the present invention.

FIG. 19 shows an overhead view of the positioning of turntable section 150 components consisting of turntable rotating section 156 and track connector ends 159. The track connector ends 159 are located almost touching rotating section 156. This is to minimize the space between them so that the individual 20 and shuttle 100 weight can be continuously supported while moving from track 120, through turntable section 156, and onto another track 120; yet allow the turntable section 156 to rotate freely, driven by motor 163, to achieve the directional placement desired using the sensors on turntable section 156 and on track connector ends 159.

Further, turntable axle 155 has axle gear ring 162, which is located on the axle below bearing housing 154. Axle gear ring 162 aligns with motor rotational drive gear 164 which is powered by motor 163. Motor 163 is mounted on the underside of bearing housing 154. Motor 163 turns drive gear 164 which meshes with gear ring 162 (on turntable axle 155) which turns rotating section 156. Axle cap 170, turntable axle 155, gear ring 162, mounting plate 165, and rotating section 156 turn together as one piece. Here, ceiling mounting plate 151, bearing housing 154, connector end mounting supports 152, and track connector ends 159 do not rotate. Turntable rotating section 156 has a throughway (shown in FIG. 16A) which contains rails 125 and rails 126 which match and align with the throughway and rails on track 120. Turntable rotating section 156 diameter is determined by the number of tracks 120 intersecting at the turntable section 150. It must be large enough so that the outside diameter is large enough to almost touch the track connector ends 159. This gives minimal clearance between connector ends 159 and turntable rotating section 156, so there is continuous support of shuttle 100 as it moves from track 120, through turntable section 156, and onto the next track 120. The diameter must also be large enough to enable throughway consisting of track profile as described for track 120, so that shuttle 110 can pass through turntable section 156 and be safely supported.

Figure 20:
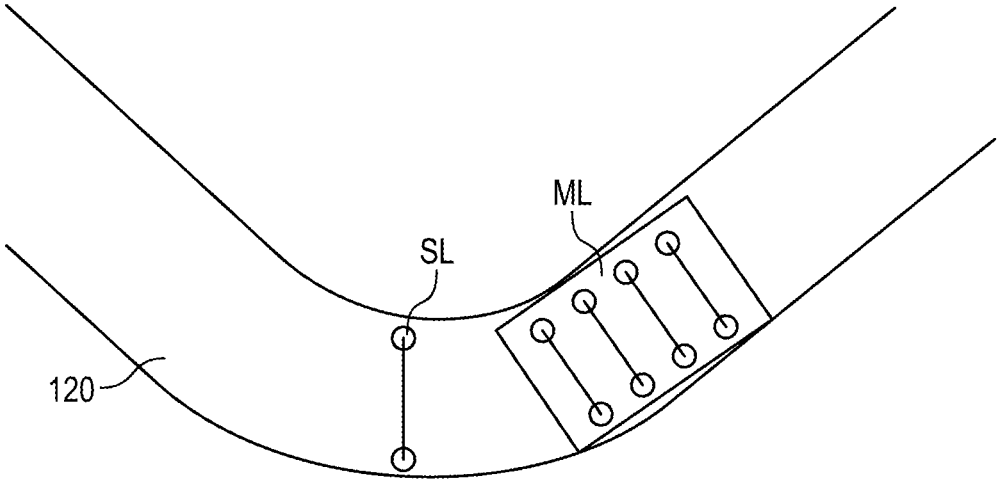
FIG. 20 illustrates a top view of a horizontally curving section of track and shows a single axle shuttle and multi axle shuttle; and illustrates how a long multi axle shuttle becomes stuck and unable to navigate a horizontally curving track, while the single axle shuttle can easily navigate the curving track.
Figure 21:
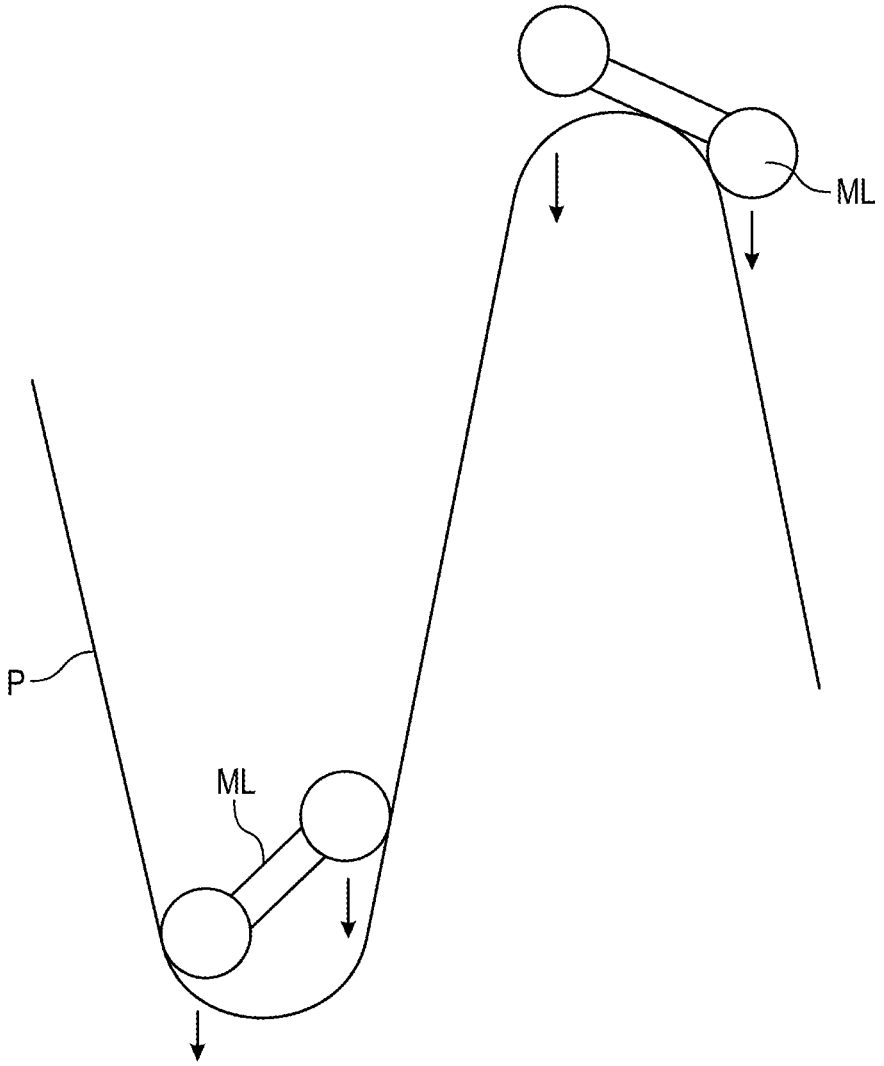
FIG. 21 illustrates a side view of a vertically curving section of track and a multi axle shuttle, and illustrates how a shuttle with more than one axle is unable to maintain contact with the track and unable to navigate the steep sections in a vertically curving track without becoming stuck, in accordance with one embodiment of the present invention.

FIG. 20 shows a top view of a horizontally curving section of track 120 with a multi load axle bearing shuttle (in prior art) and a single axle load bearing shuttle as in the present invention. The multi load axle shuttle (ML) gets stuck as the shuttle body is too long due to multiple axles spaced apart on the shuttle. In accordance with the present invention, a single load axle shuttle (SL) with a differential drive system easily navigates horizontally curving track sections. Further, FIG. 21 shows a side view of a multi load axle bearing shuttle trying to traverse a steeply vertically curving support track 120. Due to their length from multi axle (ML) spacing on a rigid body, they become stuck or high centered in the tracks and valleys or lose contact with one or more wheels and become ineffective at providing a safe support and travel means for the individual using the system. The presently disclosed single load axle shuttle (SL) with a differential drive system allows easy movement on vertically curving track when compared to multi load axle shuttle (ML). In other words, the presently disclosed SL design enables shuttle 100 to traverse horizontally curving sections of track 120 where the axle and wheel turn rates are not the same as on straight (non-curving) track. This also applies on track sections that curve and slope.

In use where tracks intersect, shuttle 100 moves along track 120 powered by motor 108 into connector end 159, and then into the turntable rotating section 156 having the throughway. The turntable rotating section 156 direction, as desired, is then accomplished by the user selecting the track 120 direction that they want to move onto, using a control module (not shown). Turntable Motor 163 rotates the rotating section 156 to align with the desired track connector end 159, so that the shuttle 100, the throughway, and track connector end 159 are all aligned. The position sensor on turntable 156 reads the sensors on the track connector ends 159 and stops the turntable section rotation when the chosen direction is accomplished. Shuttle 100 then moves from the turntable rotating section 156, onto track connector end 159 and onto track 120, all the while being safely supported.

Referring back to FIG. 12, operational features of system 12A (single axle shuttle and track) whereby shuttle 100 connects to track 120 is explained. As presented above, track 120 mounts to ceiling 14. Subsequently, sliding mechanism/shuttle 100 connects to track 120. Further, strap hanging arrangement 24 connects to shuttle 100. Further, vest 26 connects to strap hanging arrangement 24. Further, leg support mechanism 28 connects to vest 26. Upon connecting system 12A, a caretaker helps mobility impaired individual 20 to put on vest 26 and leg support mechanism (or the individual does it if they can stand and use arms, hands) 28. Subsequently, the caretaker tightens second vest straps 72, first leg strap 76 and second leg strap 80 (or the individual does it if they can use arms, hands).

Depending on whether mobility-impaired individual 20 wishes to move around in structure 16 in a sitting or standing position, the caretaker (or individual) adjusts the height of system 12. In order to adjust the height of system 12, the individual (or caretaker) operates lift motor 111 that extends (for sitting position) or wounds (for standing position) lift strap 48 around lifting axle 103. In one example, individual 20 (or caretaker) operates a switch on control box or remote controller (not shown) provided at lift motor 111 to control the length of lift strap 48 which in turn controls the extent (vertical position) of vest 26 and leg support mechanism 28. In another example, the individual 20 (or caretaker) operates lift motor 111 using a remote controller (not shown, wired or wireless controller) to control the length of lift strap 48 which in turn controls the extent (vertical position) of vest 26 and leg support mechanism 28 suspends from ceiling 14. Further, individual 20 (or caretaker) operates drive motor 108 using a manual switch or a remote controller (not shown). Upon operating, drive motor 108 drives shaft 109 which drives differential drive 106 which drives shafts 102 and 113, which in turn drives second geared wheels 105 along second gear grooved rails 126. This drives shuttle 100 forward or backward. Here, second geared wheels 105 help to maneuver sliding mechanism/shuttle 100 and in turn system 12A suspending mobility impaired individual 20 via vest 26 and leg support mechanism 28. As second geared wheels 105 drive system 12A along track 18/120, first wheels 101 bear the weight of whole system 12A and mobility impaired individual 20.

In one example, mobility-impaired individual 20 or the caretaker operates drive motor 108 to move system 12 along track 120 around structure 16 e.g., between rooms either in sitting position (FIG. 12) or standing position (FIG. 1) with a wired or wireless/remote controller (not shown). Further, mobility-impaired individual 20 or the caretaker operates lift motor 111 to adjust height of system 12A by extending or wounding lift strap 48 with the help of a wired or wireless/remote controller.

Based on the above, it is evident that the above disclosed system assists mobility-impaired individuals or patients suffering from medical conditions in the course of medical care, therapy, rehabilitation diagnostics, etc. by allowing them to move around the structure in sitting or standing position. This enables the mobility-impaired individuals to stay active and perform their daily activities without additional devices such as wheelchairs or prosthetic apparatuses.

The system can accommodate as many users as desired, throughout the structure, as the track is designed for strength according to the intended number of simultaneous users and total weight load. Additionally, multiple user's movement can be configured independent of the movement and position of the other user(s).

The presently disclosed system can be used as an "All in One System" that provides fall prevention, support during rehabilitation, mechanized movement and lifting for intermittent specific needs, and total mechanized movement and lifting for the individual that cannot walk. The system provides safe support for the user throughout their lifetime, beginning with initial need for minimal support and all the way through being unable to walk and requiring that all mobility be provided mechanically, should they have that need. The system addresses the needs of a user requiring minimal support (who can walk but may be somewhat unstable) such as a walker type of device currently provides. The system allows the user to walk on their own with as little support as required or with full support. The system easily adjusts to the need of the user. The system provides complete safe lifting and transport of the user throughout the entire home, care facility, or structure without having to be repositioned or adjusted. Further, if the user is a quadriplegic, another person can easily lift, transport, reposition, and move the user throughout a home or structure to facilitate conducting all hygiene needs such as bathing and using the toilet. The system provides a standing or sitting position for the user based on their preference during lifting and transporting.

In addition, the track configures to curve vertically and horizontally to conform to varying ceiling heights from which it is suspended (wall mount supports can also be used where dictated by the structure). This provides flexible movement in the desired areas of a room, so that it is continuous throughout a home, structure, or care facility without having to be moved or readjusted once it is installed. Further, moving the user from room to room can be accomplished easily with the horizontal and vertical flexibility of the track, as well as accessing any desired area within a room.

Alternatively, the system allows to accomplish load support and motorized movement from a single axle or dual axle. Here, load (one or more axles) is supported in a single vertical plane on the line of intersection of constantly changing vertical and horizontal planes as the user is transported throughout the structure.

The presently disclosed system acts as an overhead support design that is customizable to meet varying needs of the user(s); including continuous fall prevention support, lifting, and transporting the user throughout a single level or multi-level structure. Further, the system accommodates multiple people at the same time with movements independent of other user(s). Ideal for use in homes, nursing homes, hospitals, memory care facilities or anywhere there is a need to support multiple users at the same time. The system can be used for supporting people, animals or objects. The vest design for humans can be replaced with a suitable design to contact and secure the animal or object that is to be supported and moved. The system can be configured to include components to provide manual or programmed movement of single or multiple users throughout the structure. This can be done by selecting a specific motor driven movement from a control box, or by selecting a program from a control box (module), or by voice command when using an appropriate voice compatible technology device system, that is linked to the system.

Further, the system's track design allows the track to curve vertically, horizontally, and both at the same time to provide continuous support for the user(s) throughout a structure having multiple levels, and through doorways which typically have lower clearance than the ceiling height. No need for transfer devices to move between rooms nor for the track to be moved and set up again for a different room (space). The installed track does not interfere with existing lighting and air flow venting or fans. Track design allows track installation from existing ceiling, wall, and doorway configurations so the functional ceiling heights in the structure remain the same. An expansive planar surface does not have to be installed below the existing ceiling, which can cover up or restrict lighting, fans, air conditioning/heating vents, and lowers the overall effective ceiling height. Further, the track includes position sensors to recognize and indicate to controller, the location of the user within the structure. This also allows for automatic/programmed movements, so that the desired movement continues until the user is in the chosen location and position. It also allows for determining location and positioning of multiple users and enables their manual, or automatic/programmed movement simultaneously or individually. Furthermore, the track design contains a turntable and track intersections of multiple angles to provide greater flexibility of directional movement of user and of multiple users. This provides greater flexibility for user choice of direction, and a shorter pathway to desired location. User doesn't have to travel the entire loop to get to where they want to go.

Furthermore, the track design includes a turntable which enables movement of shuttle at intersection of tracks in varying directions, and is an intersection directional control device installed as a component of the track; it connects tracks at their intersection to continue shuttle movement in the same direction or re-direct shuttle movement in another direction. The components are a ceiling mounting bracket from which the turntable, connector ends, motor, rotational load suspending axle & bearings, and position sensors are suspended/attached.

The shuttle is designed with a single load axle design that provides load support (wholly or substantially) in a single vertical plane that is perpendicular to the horizontal direction of travel along the track; and the pivot point of the axle is in the same single vertical plane as the load support plane. The single vertical plane is defined by the intersection line of horizontal and vertical planes at the point of contact of the shuttle axle on the track at any given point. As the shuttle moves along the track, flat (planar), sloping, curving, or non-curving, the load is always supported in a single vertical plane in the same vertical plane as the intersection line of the changing planes. This single plane load axle design enables the shuttle to traverse a planar or steeply sloping track section.

Further, the shuttle may consist of a single multi-function axle (which provides weight support, motorized propulsion along the track, and position locking stability of the shuttle and user) or a dual axle design where the three functions are accomplished using two axles instead of one, with any two of the three functions being on one axle, and the third function on the second axle. Both the single axle and dual axle designs use a single "load support axle" design.

In one unique feature, the shuttle incorporates a differential drive mechanism on the drive axle, to move the shuttle in all directions but is required to enable movement on horizontally curving sections of track where the wheel turn rates are not equal; the differential drive provides shuttle movement in straight sections of track as well as horizontally curving sections of the track where the drive wheel rate of movement is different between the inside wheel and the outside wheel as the shuttle moves along the curved sections of track.

The vest in the system is designed to provide support in the standing and sitting positions with the leg support straps that are integrated into the vest design. The vest design provides safe support for multiple body positions, whether the user can walk and just needs fall prevention, or whether the user needs support and transporting, the same vest design will provide that. The leg straps are the only straps that adjust in the vertical direction. The design includes leg strap retention buckles for securing straps when not used; or when need to be moved out of the way and repositioned for bathroom functions.

A person skilled in the art appreciates that the system may come in a variety of sizes depending on the need and comfort of the mobility-impaired individuals. Further, different materials in addition to or instead of materials described herein may also be used and such implementations may be construed to be within the scope of the present invention. Further, many changes in the design and placement of components may take place without deviating from the scope of the presently disclosed system.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

What is claimed is:

1. A system for assisting a mobility-impaired individual, said system comprising:

a shuttle comprising a first shaft and a second shaft, wherein said first shaft positions above said second shaft in a single vertical plane, wherein each of said first and said second shaft comprises wheels at both ends, wherein said shuttle further comprises a motor base plate, wherein said first shaft, said second shaft and said motor base plate mount in parallel to each other, and wherein said motor base plate comprises a first motor for driving said wheels on said second shaft;

a pair of stabilizers connecting and aligning with said first shaft and said second shaft;

a third shaft connecting at distal ends of said stabilizers, wherein said third shaft positions underneath said motor base plate;

a lifting yoke comprising a lift strap with a swivel at a bottom of said lift strap, said lift strap connects to said third shaft, wherein said lifting yoke comprises straps extending from said lift strap;

a vest connecting to at least one of said straps, wherein said vest receives said mobility-impaired individual;

a leg support mechanism extending from said vest, wherein said leg support mechanism comprises leg straps for receiving legs of said mobility-impaired individual; and a track mounted to a ceiling, wherein said track curves vertically and horizontally, and wherein said track comprises first rails and second rails extending along its entire length, wherein said first rails receive said wheels connecting said first shaft and second rails receive said wheels connecting said second shaft, and wherein said first motor drives said wheels in a forward or rearward direction to move said shuttle holding said lifting yoke, said vest, said leg support mechanism along said track.

2. The system of claim 1, wherein said third shaft comprises a second motor, and wherein said second motor rotates said third shaft for extending or winding said lift strap around said third shaft for raising or lowering the height of said mobility-impaired individual suspending from said ceiling.

3. The system of claim 1, wherein said vest comprises arm positioner straps for securing arms of said impaired individual close to chest and torso.

4. The system of claim 1, wherein said shuttle supports the weight of said shuttle and all system components below said shuttle in a single vertical plane at any point of location along said track, and wherein said shuttle locks in place when not moving.

5. The system of claim 1, wherein said stabilizers comprise a position sensor at the top, wherein said ceiling comprises track sensors, and wherein said position sensor recognizes said track sensors to indicate said shuttle position along said track.

6. The system of claim 1, wherein said track comprises lower support beams, wherein said lower support beams provide additional vertical and horizontal load support for said track, and wherein lower support beams reduces horizontal sway from horizontal stress, and locks track sections together for structural integrity.

7. The system of claim 1, wherein said track comprises positional indicators along its length, and wherein said positional indicators determine the location of said shuttle along said track.

8. The system of claim 1, wherein said vest comprises balance rings, and wherein said balance rings provide freedom of movement for the mobility-impaired individual to be able to lean forward or backward and still have support.

9. The system of claim 1, wherein said second shaft comprises a differential drive unit, wherein said differential drive unit connects to said first motor via a drive shaft, and wherein said first motor operates said differential drive unit to drive said wheels on said second shaft in the forward or rearward direction.

10. The system of claim 9, wherein said differential drive unit operates said second shaft and said wheels on said second shaft to rotate at different speeds to traverse horizontally at curving sections of said track sections, and to traverse track sections which curve both horizontally and vertically at the same time.

11. The system of claim 10, wherein said track further comprises a track turntable, and wherein said track turntable connects to said track and allows said shuttle to move between intersecting track sections.

12. The system of claim 11, wherein said track turntable comprises a ceiling mounting plate connecting said ceiling, and wherein said track turntable comprises track connector ends having connector pins with identical profile as said track for connecting said track turntable to said track.

13. The system of claim 12, wherein said track turntable further comprises a bearing housing mounted underneath said ceiling mounting plate, wherein said bearing housing comprises a turntable axle having an axle cap at the top, and wherein said turntable axle connects to a turntable rotating section at the bottom via a turntable mounting plate.

14. The system of claim 13, wherein said track turntable comprises a third motor mounted underside said bearing housing, and wherein said third motor drives a drive gear for turning said turntable rotating section, said axle cap, said turntable axle, said drive gear and said turntable mounting plate together.

15. The system of claim 11, further comprises sensors positioned at said shuttle, said track, said track turntable and said straps for determining and positioning the location of the mobility-impaired individual along said track.

16. A method of providing a system for assisting a mobility-impaired individual, said method comprising the steps of:

providing a shuttle comprising a first shaft and a second shaft, said first shaft positioning above said second shaft in a single vertical plane, each of said first and said second shaft having wheels at both ends, said shuttle further comprising a motor base plate positioning in parallel to said first shaft and said second shaft, said motor base plate comprising a first motor for driving said wheels;

providing stabilizers connecting and aligning with said first shaft and said second shaft;

providing a third shaft connecting at distal ends of said stabilizers, said third shaft positioning underneath said motor base plate;

providing a lifting yoke comprising a lift strap with a swivel at a bottom of said lift strap, said lift strap connecting said third shaft to, said lifting yoke comprising straps extending from said lift strap;

providing a vest connecting said straps, said vest receiving said mobility-impaired individual;

providing a leg support mechanism extending from said vest, said leg support mechanism comprising leg straps for receiving legs of said mobility-impaired individual;

providing a track mounted to a ceiling, said track curving vertically and horizontally, said track comprising first rails and second rails extending along its entire length;

receiving said wheels of said first shaft at said first rails, and said wheels of said second shaft at second rails; and driving said wheels of said second shaft in a forward or rearward direction using said first motor to move said shuttle holding said lifting yoke, said vest, said leg support mechanism along said track.

17. The method of claim 16, further comprising a second motor for rotating said third shaft for extending or winding said lift strap around said third shaft for raising or lowering the height of said mobility-impaired individual suspending from said ceiling.

18. The method of claim 16, further comprising:

providing a differential drive unit at said first or second shaft;

connecting said differential drive unit to said first motor via a drive shaft; and operating said first motor for powering said differential drive unit to drive said wheels in said forward or rearward direction.

19. The method of claim 18, further comprising operating said differential drive unit for rotating a vest connecting to at least one of said straps at different speeds for traversing horizontally at curving sections of said track sections, and to traverse track sections which curve both horizontally and vertically at the same time.

20. The method of claim 19, further comprising:

providing a track turntable connecting said track for moving between intersecting track sections;

providing a ceiling mounting plate for suspending said track turntable from said ceiling;

providing a bearing housing underneath said ceiling mounting plate, said bearing housing encompassing a turntable axle having an axle cap at the top;

connecting said turntable axle to a turntable rotating section at the bottom via a turntable mounting plate;

providing a third motor underside said bearing housing; and operating said third motor for driving a drive gear for turning said turntable rotating section, said axle cap, said turntable axle, said drive gear and said turntable mounting plate together.

* * * * *